US011008797B2

(12) United States Patent
Termine et al.

(10) Patent No.: US 11,008,797 B2
(45) Date of Patent: May 18, 2021

(54) POWER DOOR PRESENTER

(71) Applicant: MAGNA CLOSURES INC., Newmarket (CA)

(72) Inventors: Fabio Termine, Leghorn (IT); Francesco Cumbo, Pisa (IT)

(73) Assignee: MAGNA CLOSURES INC., Newmarket (CA)

( * ) Notice: Subject to any disclaimer, the term of this patent is extended or adjusted under 35 U.S.C. 154(b) by 268 days.

(21) Appl. No.: 16/190,642

(22) Filed: Nov. 14, 2018

(65) Prior Publication Data

US 2019/0153768 A1 May 23, 2019

Related U.S. Application Data

(60) Provisional application No. 62/589,792, filed on Nov. 22, 2017.

(51) Int. Cl.
*E05F 15/622* (2015.01)

(52) U.S. Cl.
CPC ..... *E05F 15/622* (2015.01); *E05Y 2900/531* (2013.01)

(58) Field of Classification Search
CPC ..... E05F 15/622; E05F 15/616
USPC ..... 49/276
See application file for complete search history.

(56) References Cited

U.S. PATENT DOCUMENTS

| | | | | |
|---|---|---|---|---|
| 4,183,177 | A * | 1/1980 | Kurdziel | E05B 77/48 49/25 |
| 4,679,451 | A * | 7/1987 | Nakamura | F16H 25/20 74/606 R |
| 5,369,911 | A * | 12/1994 | Fortunato | E05F 5/025 49/25 |
| 5,910,692 | A * | 6/1999 | Saeda | F16H 25/20 310/13 |
| 9,174,517 | B2 * | 11/2015 | Scheuring | B60J 5/047 |
| 9,353,566 | B2 * | 5/2016 | Miu | E05F 15/73 |
| 9,995,066 | B1 * | 6/2018 | Ottolini | E05F 15/616 |
| 10,041,281 | B1 * | 8/2018 | Miu | E05C 17/006 |
| 10,633,893 | B2 | 4/2020 | Harajli et al. | |
| 10,683,691 | B2 * | 6/2020 | Podkopayev | E05F 15/622 |
| 10,697,224 | B2 * | 6/2020 | Linden | B60J 5/047 |
| 10,711,503 | B2 * | 7/2020 | Linden | E05F 15/619 |
| 10,711,504 | B2 * | 7/2020 | Roos | E05B 81/06 |

(Continued)

FOREIGN PATENT DOCUMENTS

| | | | | |
|---|---|---|---|---|
| JP | 2004003774 A * | 1/2004 | | E05F 15/622 |
| WO | 2017160787 A1 | 9/2017 | | |

*Primary Examiner* — Marcus Menezes
(74) *Attorney, Agent, or Firm* — Dickinson Wright PLLC

(57) ABSTRACT

A power door actuation system for a vehicle door includes a power-operated presenter actuator mounted to one of the vehicle body and the vehicle door. The power-operated presenter actuator includes a motor and an extensible member being translatable between a retracted position and an extended position along a first axis in response to selective actuation of the motor. The motor has a motor shaft that extends along a second axis that is substantially parallel to the first axis along which the extensible member translates. Powered movement of the extensible member between its retracted and extended positions results in corresponding movement of the vehicle door between closed and presented positions.

14 Claims, 14 Drawing Sheets

(56) References Cited

U.S. PATENT DOCUMENTS

| | | | | |
|---|---|---|---|---|
| 2008/0020893 | A1* | 1/2008 | Frieb-Preis | E05F 15/622 476/64 |
| 2009/0113803 | A1* | 5/2009 | Arenz | E05F 15/622 49/358 |
| 2012/0204490 | A1* | 8/2012 | Lanigan | E05F 15/53 49/30 |
| 2015/0330116 | A1 | 11/2015 | Dente | |
| 2018/0223583 | A1* | 8/2018 | Podkopayev | F16D 3/207 |
| 2019/0292818 | A1* | 9/2019 | Cumbo | E05B 81/14 |
| 2020/0011111 | A1 | 1/2020 | Khan et al. | |
| 2020/0056414 | A1* | 2/2020 | Oestermann | E05F 15/79 |
| 2020/0263459 | A1* | 8/2020 | Debroucke | E05B 81/20 |

* cited by examiner

POWER DOOR PRESENTER

CROSS-REFERENCE TO RELATED APPLICATIONS

This U.S. Patent Application claims the benefit of U.S. Provisional Patent Application Ser. No. 62/589,792 filed Nov. 22, 2017, entitled "Power Door Presenter," the entire disclosure of the application being considered part of the disclosure of this application and hereby incorporated by reference.

FIELD

The present disclosure relates generally to power door systems for motor vehicles. More particularly, the present disclosure is directed to a power door actuation system equipped with a power door presenter assembly operable for powered movement of a vehicle door relative to a vehicle body between a closed position and an open position.

BACKGROUND

This section provides background information related to the present disclosure which is not necessarily prior art.

In view of increased consumer demand for motor vehicles equipped with advanced comfort and convenience features, many current vehicles are now provided with passive keyless entry systems to permit locking and release of the passenger doors without the use of traditional key-type manual entry systems. As a further advancement, power door actuation systems have been developed which function to automatically swing the passenger door about its pivot axis between its open and closed positions without any manual intervention with the door by a user. As a result, vehicle manufacturers are foregoing the integration of traditional door handles on the exterior of the vehicle door resulting in cost and weight savings, as well as styling and aerodynamic benefits. In lieu, such door handles are being replaced with wireless key fobs and/or electronic sensors i.e. touch/touchless sensors. For example, a capacitive touch pad may be provided to replace an external handle or unlock switch which is in communication with an electronic latch to command the unlock of the latch and the operation of the power door actuation system(s) to open the door.

Typically, such power door actuation systems include a power-operated device such as, for example, a power swing door actuator having an electric motor and a rotary-to-linear conversion device that are operable for converting the rotary output of the electric motor into translational movement of an extensible member. In many power door actuator arrangements, the power swing door actuator is mounted to the passenger door and the distal end of the extensible member is fixedly secured to the vehicle body. One example of a door-mounted power door actuation system is shown in commonly-owned U.S. Pat. No. 9,174,517 with a power swing door actuator having a rotary-to-linear conversion device configured to include an externally-threaded leadscrew rotatively driven by the electric motor and an internally-threaded drive nut meshingly engaged with the leadscrew and to which the extensible member is attached. Accordingly, control over the speed and direction of rotation of the leadscrew results in control over the speed and direction of translational movement of the drive nut and the extensible member for controlling swinging movement of the passenger door between its open and closed positions. Operation of the power swing door actuator is controlled in coordination with the power release operation of the primary latch assembly via the passive keyless entry system.

Some other door actuation systems, known as door presenter systems, are configured to include a power-operated door presenter assembly operable to "present" the door by opening it only a predetermined amount, or distance, from a closed position to a partially-open position so as to allow subsequent manual movement of the door to its fully-open position.

Because vehicle doors are more frequently being equipped with multiple door actuation systems tending to add weight to the vehicle door, increase costs, and reduce the available space within the door cavity for receiving such door actuation systems, it would be advantageous to provide the door presenter assembly as a compact assembly, thereby minimizing the amount of space needed to accommodate the assembly, while at the same time providing the assembly with the power needed to perform its intended function.

Further, because of vehicle manufactures' design choices trending towards the elimination of door handles, such as exterior door handles, and towards hands-free entry, the problem arises of being able to open the vehicle door in the event of a door seized or jammed condition, for example as occurring as a result of a damaged door or an iced over condition requiring an increased opening force to overcome this seized or jammed condition. Also, the problem of a vehicle condition including a failure of the main power source supplying the electrical energy required for operating the door actuation systems, or other emergency conditions requiring a user to open the vehicle door from the exterior of the vehicle can be exacerbated for a handless door system, since there is no door handle to grasp and move the door. Operating the power swing door actuator with energy provided from a backup energy source including an auxiliary battery or super capacitor arranged within the door designed to supply power to the power swing door actuator during such situations in order to move the door to an opened or presented position where at the door is in a position to be manually moved (for example, an emergency response personnel grasping the door edge and manually moving the door following a vehicle crash), can help overcome this problem. One drawback however associated with opening the door by operating the power swing door actuator is related to the high energy demand placed on the backup energy source by the power swing door actuator due to the high force/torque required to initially move the door as a result of the geometry of the hinge pivot points relative to the action of power swing door actuator between the vehicle door and body (small moment arm).

In view of the above, there remains a need to develop alternative power door presenter systems which address and overcome limitations associated with known power door actuation systems as well as to provide increased applicability while reducing cost and complexity.

SUMMARY

This section provides a general summary of the present disclosure and is not a comprehensive disclosure of its full scope or all of its features, aspects and objectives.

It is an aspect of the present disclosure to provide a compact power swing door actuation system for moving a vehicle door about a vertical axis between partially-open or deployed positions and closed positions relative to a vehicle body.

In a related aspect, a power door presenter for a motor vehicle having a vehicle door moveable relative to a vehicle body between a closed position, a presented position, and a fully-open position is provided. The power door presenter includes a power-operated presenter actuator mounted to one of the vehicle body and the vehicle door, the power-operated presenter actuator including a motor and an extensible member being moveable between a retracted position and an extended position along a first axis. The motor has a motor shaft extending along a second axis and being operable for powered movement of the extensible member between its retracted and extended position, which results in corresponding movement of the vehicle door between the closed position and the presented position, and wherein the first axis along which the extensible member extends is parallel or substantially parallel, to the second axis along which the motor shaft extends, thereby providing for a compact, lightweight power door presenter system.

In a further related aspect, the power swing door actuation system for the vehicle door includes providing a compact power door presenter assembly integrated into a latch. The compact power door presenter assembly includes an extensible member extending along a first axis, with the extensible member being configured to be driven by a motor having an output shaft extending along a second axis in parallel, or generally parallel relation to the first axis, wherein the output shaft is operably configured to drive the extensible member between retracted and extended positions along the first axis.

In accordance with these and other aspects, a compact power swing door actuation system is provided for use in a motor vehicle having a vehicle body defining a door opening and a vehicle door pivotably connected to the vehicle body for swing movement about a vertical axis along a swing path between fully-open and closed positions relative to the door opening. The compact power swing door actuation system of the present disclosure includes a power door presenter assembly attached to one of the vehicle door and the vehicle body.

The power swing door actuation system of the present disclosure includes a compact power door presenter assembly attached to one of the vehicle door and the vehicle body having a presenter actuator and an extensible member extending along a first axis configured to be driven by a motor having an output shaft extending along a second axis in generally parallel relation to the first axis. In accordance with the disclosed embodiments, the compact door presenter assembly functions to: provide door movement from a closed position to a deployed position within a predetermined range of swinging motion; allow the extensible member of the presenter assembly to be retracted from its deployed position in response to the user pushing upon the door towards its closed position to urge the extensible member from its deployed position to its retracted position. It is recognized that the compact presenter assembly can be deployed in conjunction with either a latch as part of an integral unit, or be a stand-alone unit deployed in the door or the vehicle body.

In accordance with another aspect, there is provided a method of controlling movement of a vehicle door from a fully closed position to a fully open position, the method including the steps of controlling a power-operated presenter actuator mounted to one of a vehicle body and the vehicle door, the power-operated presenter actuator including an extensible member being moveable between a retracted position and an extended position to abut with the other one of the vehicle body and vehicle door to move the vehicle door from the fully closed position to a presented position, and controlling a powered swing door actuator coupled between the vehicle body and the vehicle door subsequent to the vehicle door reaching the presented position to move the vehicle door from the presented position to the fully-opened position.

BRIEF DESCRIPTION OF THE DRAWINGS

Other advantages of the present disclosure will be readily appreciated, as the same becomes better understood by reference to the following detailed description when considered in connection with the accompanying drawings wherein.

DETAILED DESCRIPTION OF EXAMPLE EMBODIMENTS

In general, example embodiments of a power door actuation system constructed in accordance with the teachings of the present disclosure will now be disclosed. The example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are described in detail.

Figure 1A:
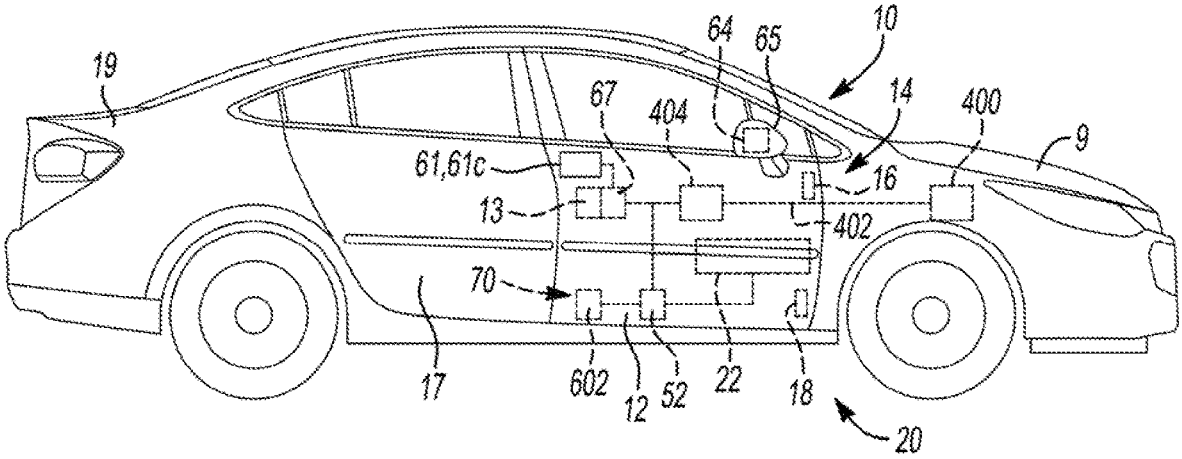
FIG. 1A illustrates an example motor vehicle equipped with a power door actuation system situated between a front passenger swing door and a vehicle body and which is configured to include a compact power door presenter assembly.

Referring initially to FIG. 1A, an example motor vehicle 10 is shown to include a first passenger door 12 pivotally mounted to a vehicle body 14 via an upper door hinge 16 and a lower door hinge 18 which are shown in phantom lines. In accordance with the present disclosure, a power door actuation system 20 is associated with the pivotal connection between first passenger door 12 and vehicle body 14. In accordance with a preferred configuration, power door actuation system 20 includes a power door presenter system 70, a vehicle door ECU 52, a primary latch assembly 13, and can also be configured with a power-operated swing door actuator 22 secured within an internal cavity of passenger door 12 for coordinated control of the opening and closing of the door 12. The motor vehicle 10 is illustrated in FIG. 1A may be provided as not including outside vehicle door handles on the vehicle door 12, and also in an alternate embodiment, outside door handles may be provided, an example of which is described herein below and illustrated in FIG. 1C. A weather seal 3 is provided around the perimeter opening into the cabin 7 along the body 14 for engaging with the door 12 when the door 12 is in the fully closed position, to compress the seal 3 (see FIGS. 13 and 14) there between and provide a weather tight seal against ingress of external environmental conditions, such as road noise and rain and wind. Such a seal 3 generates a seal load on the striker 37 tending to urge the striker 37 out of the fishmouth of the latch assembly 13.

Figure 1B:
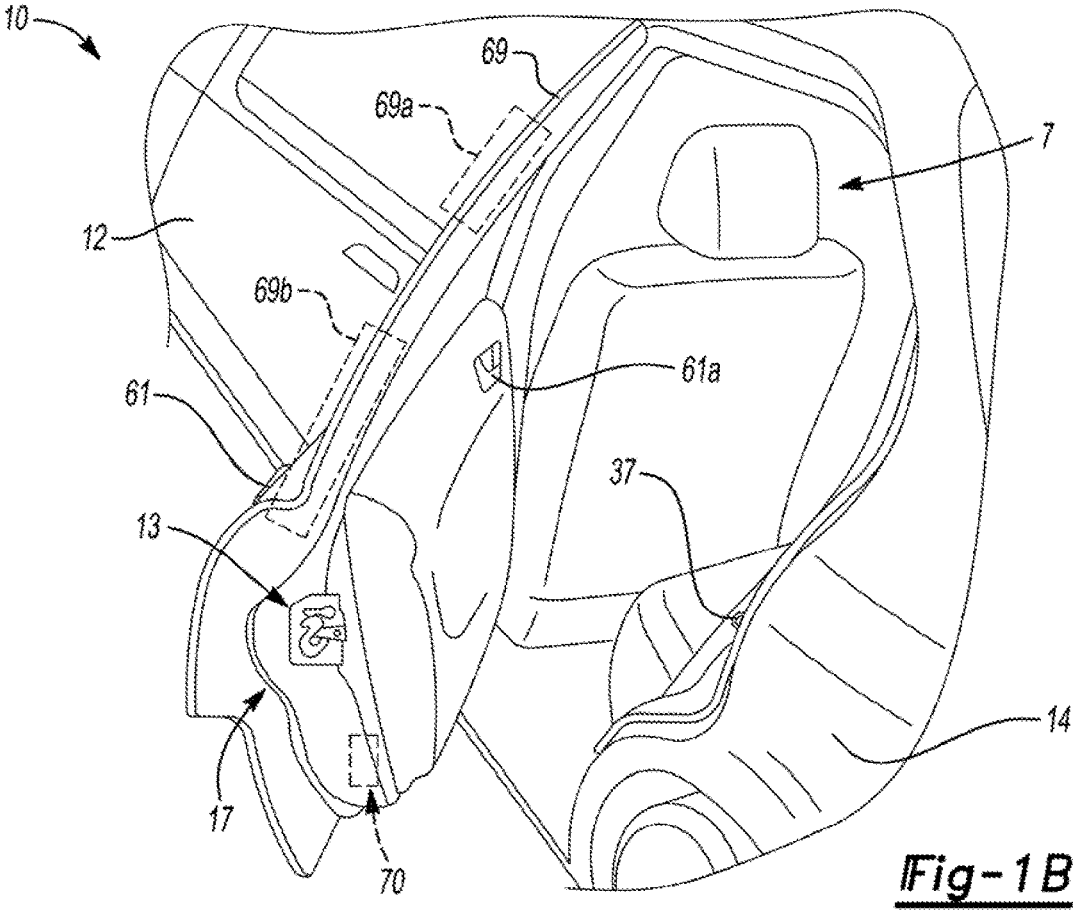
FIG. 1B is a view showing a primary latch assembly and a compact power door presenter installed in a passenger swing door associated with the vehicle shown in FIG. 1A.

Each of upper door hinge 16 and lower door hinge 18 include a door-mounting hinge component and a body-mounted hinge component that are pivotably interconnected by a hinge pin or post. While power door actuation system 20 is only shown in FIG. 1A in association with front passenger door 12, those skilled in the art will recognize that the power door actuation system 20 can also be associated with any other door, such as rear passenger doors 17 as shown in FIG. 1B, or also be associated with a liftgate (not shown), a hood 9, or a decklid 19. Also, while the door 12 is illustrated herein as being pivotally mounted to the vehicle body 14 for rotation relative to a vertical axis, it may be configured for rotation about a horizontal axis as would be the case for a liftgate, or other offset axis, or the like. For greater clarity, the vehicle body 14 is intended to include the 'non-moving' structural elements of the vehicle 10 such as the vehicle frame, structural support pillars and members, and body panels.

Figure 1C:
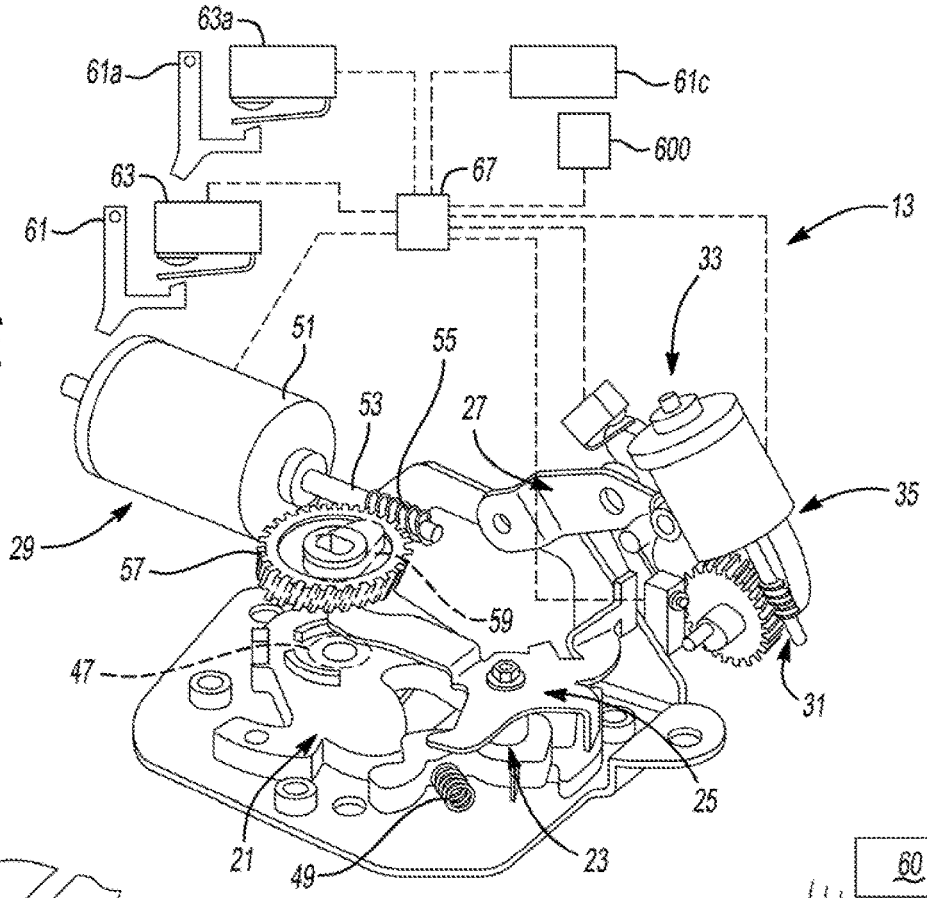
FIG. 1C illustrates an example embodiment of the primary latch assembly shown in FIG. 1B.

Referring to FIGS. 1B and 1C, shown is a non-limiting embodiment of a primary closure latch assembly 13 for vehicle doors 12, 17 of vehicle 10. Closure latch assembly 13 can be positioned on vehicle door 12, 17 and arranged in a suitable orientation to engage a striker 37, mounted on vehicle body 14, when door 12, 17 is closed. Closure latch assembly 13 includes a latch mechanism having a ratchet 21 and a pawl 23, a latch release mechanism having a pawl release lever 25, an inside door release mechanism having an inside release lever 27, a power release actuator 29 for controlling powered actuation of the latch release mechanism, and a power lock actuator 31 having a lock mechanism 33 and an electric lock motor 35. Ratchet 21 is movable between two striker capture positions including primary or fully closed position (shown in FIG. 1C) and secondary or partially closed position (not shown) whereat ratchet 21 retains striker 37, and a striker release position (FIG. 1B) whereat ratchet 21 permits release of striker 37 from a fishmouth provided by a latch housing of primary latch assembly 13. Referring to FIG. 1C, a ratchet biasing member 47, such as a spring, is provided to normally bias ratchet 21 toward its striker release position. Pawl 23 is movable between a ratchet holding position (FIG. 1C) whereat pawl 23 holds ratchet 21 in its striker capture position, and a ratchet releasing position whereat pawl 23 permits ratchet 21 to move to its striker release position. A pawl biasing member 49, such as a suitable spring, is provided to normally bias pawl 23 toward its ratchet holding position.

Pawl release lever 25 is operatively connected to pawl 23 and is movable between a pawl release position whereat pawl release lever 25 moves pawl 23 to its ratchet releasing position, and a home position whereat pawl release lever 25 permits pawl 23 to be in its ratchet holding position. A release lever biasing member (not shown), such as a suitable spring, is provided to normally bias pawl release lever 25 toward its home position. Pawl release lever 25 can be moved to its pawl release position by several components, such as, for example, by power release actuator 29 and by inside door release lever 27. Power release actuator 29 includes a power release motor 51 having an output shaft 53, a power release worm gear 55 mounted on output shaft 53, and a power release gear 57. A power release cam 59 is connected for rotation with power release gear 57 and is rotatable between a pawl release range of positions and a pawl non-release range of positions. In FIG. 1C, power release cam 59 is located in a position that is within the pawl non-release range. Power release gear 57 is driven by worm gear 55 for driving cam 59 which, in turn, drives pawl release lever 25 from its home position into its pawl release position.

Power release actuator 29 can be used as part of a conventional passive keyless entry feature. When a person approaches vehicle 10 with an electronic key fob 60 (FIG. 2) and actuates an outside door handle 61, for example, sensing both the presence of key fob 60 and that door handle 61 has been actuated (e.g. via communication between a switch 63 (FIG. 1C) and an electronic latch control unit (ECU) shown at 67 (FIG. 1C) that at least partially controls the operation of closure latch assembly 13). In turn, latch ECU 67 actuates power release actuator 29 to cause the latch release mechanism to release the latch mechanism and shift primary closure latch assembly 13 into an unlatched operating state so as to facilitate subsequent opening of vehicle door 12. Power release actuator 29 can be alternatively activated as part of a proximity sensor based entry feature (radar based proximity detection for example), for example when a person approaches vehicle 10 with an electronic key fob 60 (FIG. 2) and actuates a proximity sensor 61*c*, such as a capacitive sensor, or other touch/touchless based sensor (based on a recognition of the proximity of an object, such as the touch/swipe/hover/gesture or a hand or finger, or the like), (e.g. via communication between the proximity sensor 61*c* (FIG. 1C) and an electronic latch control unit (ECU) shown at 67 (FIG. 1C) that at least partially controls the operation of closure latch assembly 13). In turn, latch ECU 67 actuates power release actuator 29 to cause the latch release mechanism to release the latch mechanism and shift primary closure latch assembly 13 into an unlatched operating state so as to facilitate subsequent opening of vehicle door 12. Also, power release actuator 29 can be used in coordinated operation with power power-operated swing door actuator 22 and power door presenter system 70, as further described below.

Figure 3A:
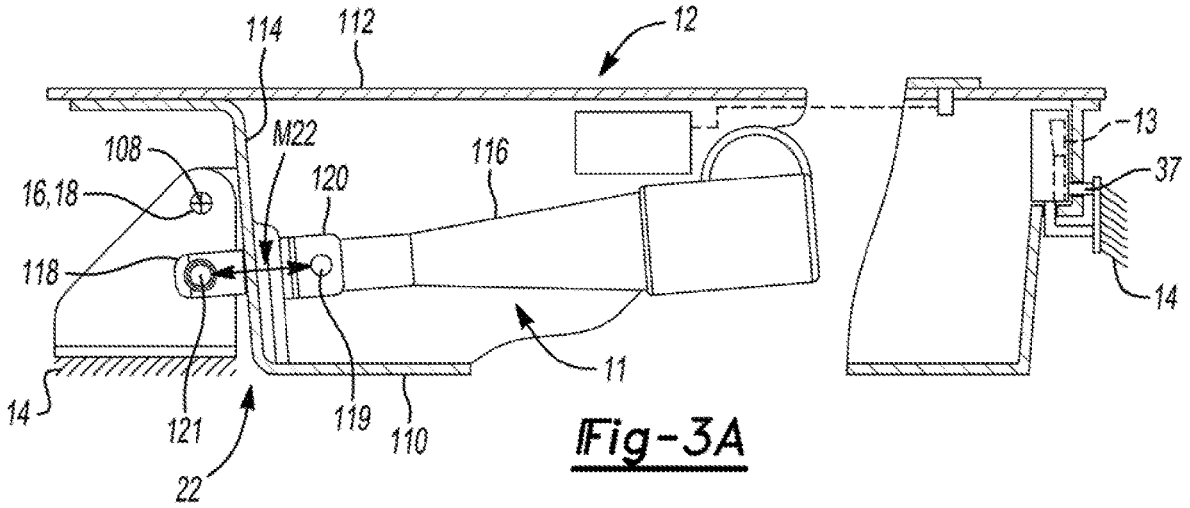
FIGS. 3A, 3B and 3C are schematic views of a power swing door actuator according to a first embodiment of the present disclosure and which is operably arranged between the vehicle body and the swing door for moving the swing door between a closed position, one or more partially-open positions, and a fully-open position, respectively.
Figure 3B:
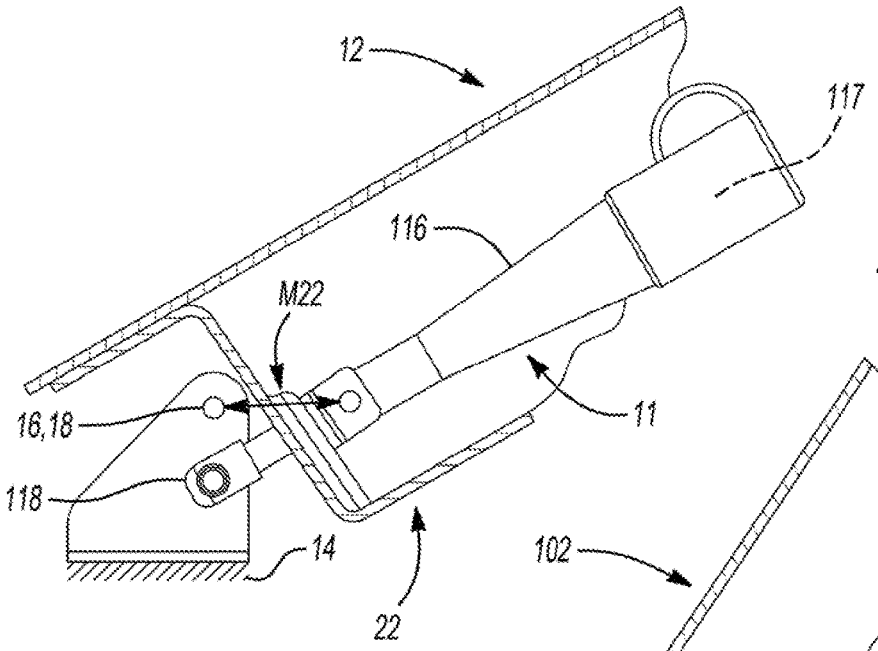
Figure 3C:
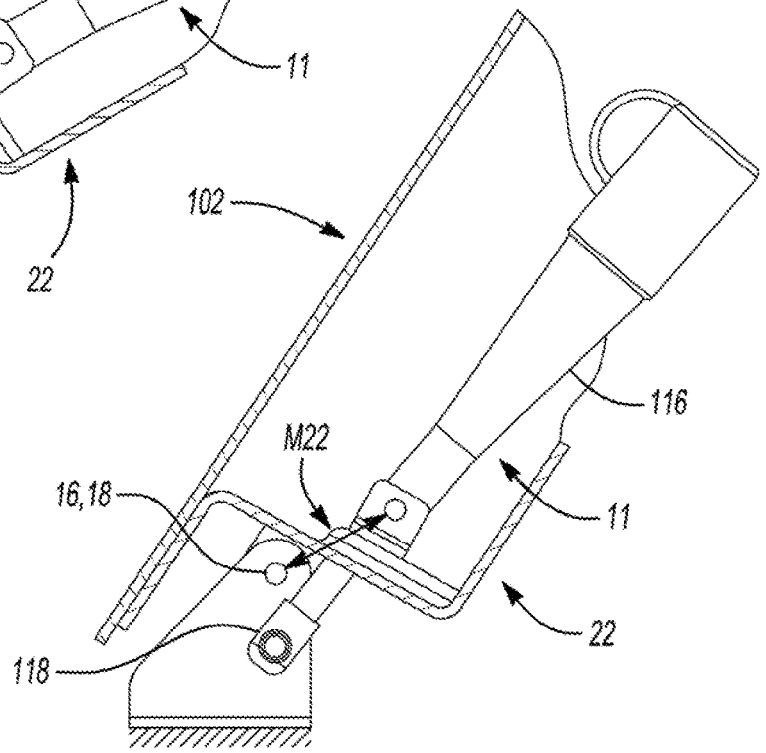
Figure 4:
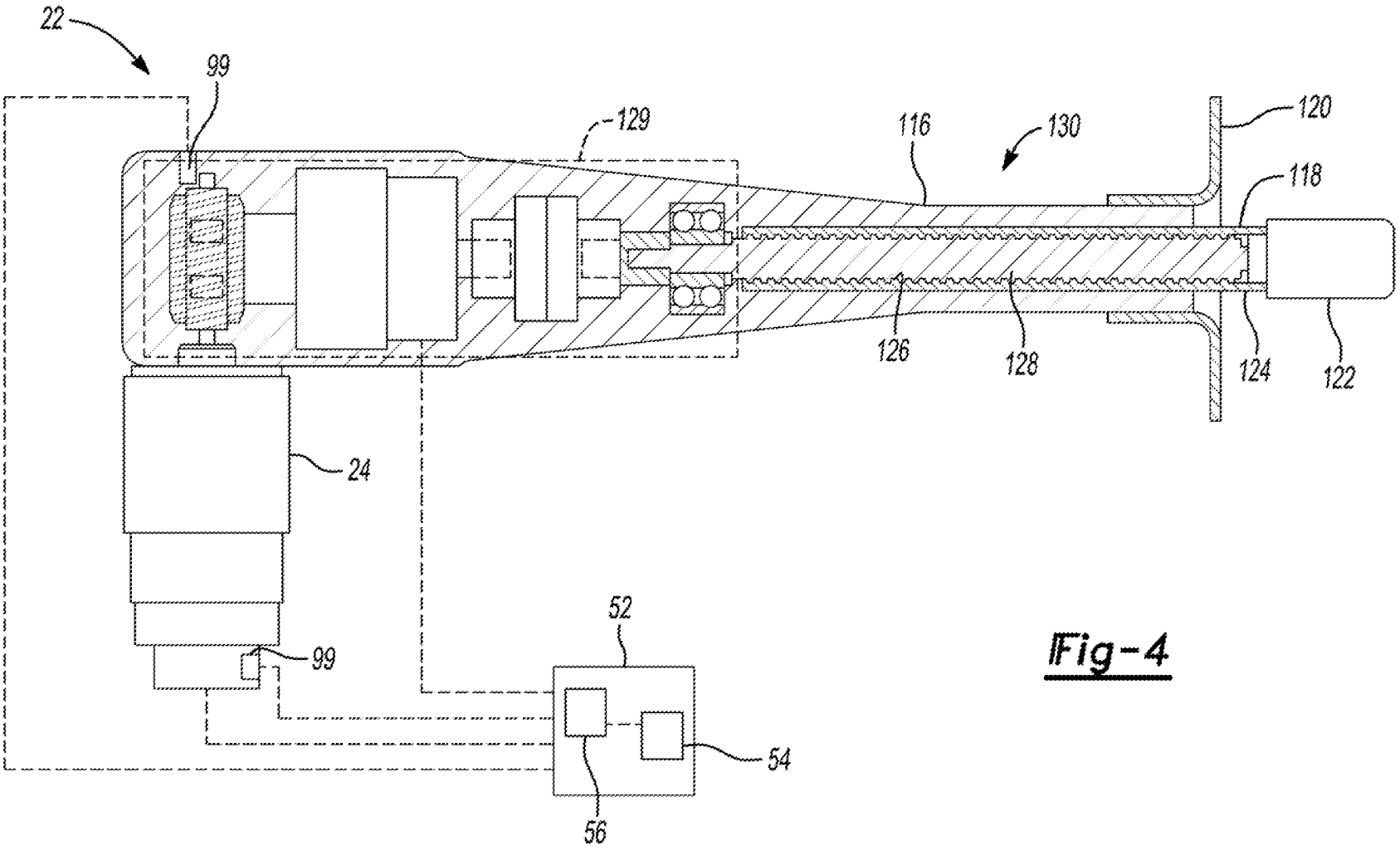
FIG. 4 is a sectional view of the power swing door actuator shown in FIGS. 3A, 3B and 3C.

With reference to FIGS. 3A to 4, power door actuation system 20 can include a power-operated swing door actuator 22 having the features of being typically mounted in door 12 and located near door hinges 16, 18; providing for full or partial open/close movement of door 12 under actuation; providing an infinite door check function; and providing for manual override (via a slip clutch) of power-operated swing door actuator 22, as desired. Power operated swing door actuator 22 can function to automatically swing passenger door 12 about its pivot axis between its open and closed positions. Typically, power-operated swing door actuator 22 can include a power-operated device such as, for example, an electric motor 24 and a rotary-to-linear conversion device 130 that are operable for converting the rotary output of the electric motor 24 into translational movement of an extensible member 118. In many power door actuation arrangements, the electric motor 24 and the conversion device 130 are mounted to passenger door 12 and a distal end of an extensible member 118 is fixedly secured to vehicle body 14 proximal the door hinges 16, 18. Driven rotation of the electric motor 24 causes translational movement of the extensible component 118 which, in turn, controls pivotal movement of passenger door 12 relative to vehicle body 14. As also shown, an electronic control module, or referred herein to as swing door ECU 52, is in communication with electric motor 24 for providing electric control signals thereto for control thereof. Swing door ECU 52 can include hardware such as a microprocessor 54 and a memory 56 having executable computer readable instructions stored thereon for implementing the control logic stored as a set of computer readable instructions in memory 56 for operating the power door actuation system 20.

The distance between the door hinges 16, 18 centerlines 108 and the axis 121 of the power-operated swing door actuator 22 is called the "Moment Arm". Due to the kinematics there may be an inherent increase and decrease of the moment arm during the door swing depending on the geometry of the door hinges 16, 18 centerlines and the axis of the power-operated swing door actuator 22. As a result of the illustrative configuration of the extensible member 118 relative to the door hinges 16, 18, the initial opening of the door 12 from a closed position requires a high torque output by the motor 24 on the extensible member 118 due to the small moment arm M22 between the force applied by the extensible member 118 on the door 12 and the door hinges 16, 18. As the door 12 swings open, the required torque output decreases as the moment arm M22 increases.

FIGS. 3A, 3B and 3C show an embodiment of the power-operated swing door actuator 22 in operation to move the door 12 between a closed position, a mid-position, and an open position, respectively. In the context of the present disclosure, the power-operated swing door actuator 22 may be operated to move the door 12 from a presented position, or assist with the presentment of the door 12 by the power door presenter system 70, as will be discussed further herein below. The door 12 includes inner and outer sheet metal panels 110 and 112 with a connecting portion 114 between the inner and outer sheet metal panels 110 and 112. The power-operated swing door actuator 22 has a housing 116 and an extensible member 118. The extensible member 118 is moveable between extended and retracted positions relative to housing 116. The power-operated swing door actuator 22 may be mounted between the inner and outer sheet metal panels 110, 112, in a lengthwise orientation, where the actuator housing 116 is fixed (e.g. permanently fixed, for example using bolts or other fastener types) to the swing door 12 via a bracket 120 mounted to the connecting door portion 114. The extensible member 118 is mounted (e.g. permanently fixed, for example using bolts or other fastener types) to the vehicle body 14 via bracket 123. The power-operated swing door actuator 22 shown in FIGS. 3A-3C includes the extensible member 118 that has a longitudinal axis that is coaxial or concentric with longitudinal axis of the motor 117, and it is recognized as having a footprint of a large lengthwise L packaging dimension requiring to be positioned lengthwise LW within the vehicle door 12.

Referring additionally to the cross-sectional view of the power-operated swing door actuator 22 in FIG. 4, the housing 116 defines a cylindrical chamber in which the extensible member 118 slides. The extensible member 118 has a ball socket 122 at an external end thereof for attachment (e.g. permanent attachment) to the vehicle body 14. The ball socket 122 is connected to a cylindrical tube 124 which has an internal thread 126 proximate an internal end of the extensible shaft 118. The internal thread 126 is engageble with a lead screw 128 driven by the electric motor 24 via a drive train 129 including various gear, clutch and transmission mechanisms, as generally known in the art. The power-operated swing door actuator 22 shown in FIG. 4 includes the extensible member 118 that has a longitudinal axis LE that is non-coaxial and non-adjacent with longitudinal axis LM of the motor 117, and it is recognized as having a smaller lengthwise LW footprint than the power-operated swing door actuator 22 FIG. 3A, however having of a larger widthwise WW packaging dimension requiring a wider width of the door 12 to be packaged within.

Of course, other power-operated swing door actuator configurations may be employed.

Now referring back to FIGS. 1B and 1C, the door 12 may have a conventional opening lever or inside door handle 61*a* located on an interior facing side of the door 12 facing the inside of the passenger compartment 7 for opening the door 12 (e.g. including unlocking and opening the door latch 13, as well as commanding operation of the power door presenter system 70 and/or the power-operated swing door actuator 22). This opening lever or inside door handle 61*a* can trigger a switch 63*a* connected to the latch ECU 67 such that, when the switch 63*a* is actuated, the latch ECU 67 facilitates that the power door presenter system 70 is activated (i.e. the extension member 618 is deployed or extended and thus facilitates powered presentment or movement of the door 12. Subsequent such presentment, the latch ECU 67 may facilitate that the power-operated swing door actuator 22 is activated (i.e. the extension member 118 is deployed or extended) to continue the automatic opening of the door 12. In the alternative, the power-operated swing door actuator 22 may be powered on at a point before the final presentment position is reached so as to provide a seamless transition between the two stages of door opening (i.e. both motors are overlapping in operation for a short time period). Alternatively, the latch ECU 67 may facilitate that the power-operated swing door actuator 22 is operated as a door check (i.e. the extension member 118 is deployed or extended and maintained at such a deployed or extended condition) until the user manually takes control of the door 12 to further open it to a fully opened position.

Now referring back to FIG. 1A, the power door actuation system 20 and the primary closure latch assembly 13 are electrically connected to a main power source 400 of the motor vehicle 10, for example a main battery providing a battery voltage $V_{batt}$ of 12 V, through an electrical connection element 402, for example a power cable (the main power source 400 may equally include a different source of electrical energy within the motor vehicle 10, for example an alternator). The electronic latch ECU 67 and/or swing door ECU 52 are also coupled to the main power source 400 of the motor vehicle 10, so as to receive the battery voltage $V_{batt}$; the electronic latch ECU 67 and/or swing door ECU 52 are thus able to check if the value of the battery voltage $V_{batt}$ decreases below a predetermined threshold value, to promptly determine if an emergency condition (when a backup energy source may be needed) occurs.

Figure 2:
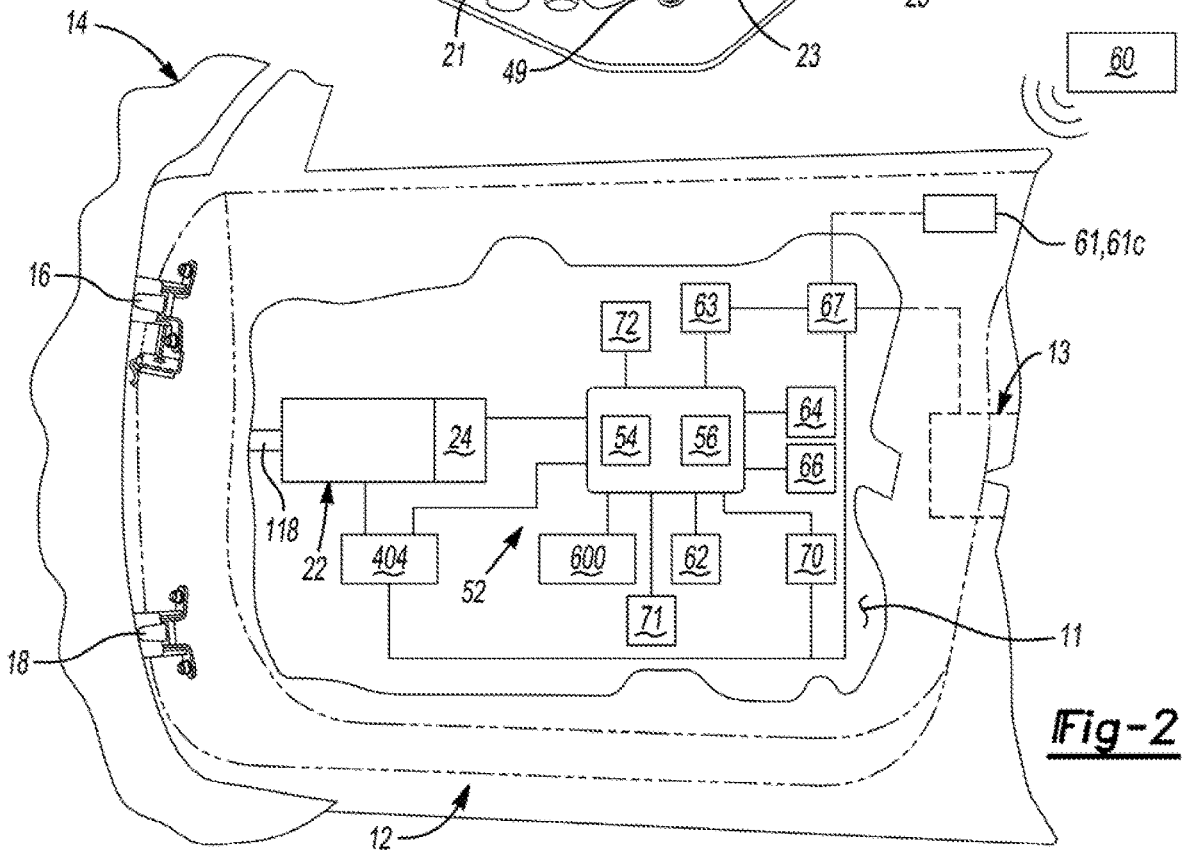
FIG. 2 is a diagrammatic view of the front passenger door shown in FIG. 1A, with various components removed for clarity purposes only, in relation to a portion of the vehicle body and which is equipped with the power door actuation system of the present disclosure.

As shown in the schematic block diagram of FIG. 1A and FIG. 2, a backup energy source 404, which may be integrated forming part of an electronic control circuit of the electronic latch ECU 67 and/or swing door ECU 52, or may be separate therefrom, is configured to supply electrical energy to the power door actuation system 20 and/or the primary closure latch assembly 13, and to the same electronic control circuit of the electronic latch ECU 67 and/or swing door ECU 52, in case of failure or interruption of the main power supply from the main power source 400 of the motor vehicle 10. In an illustrative embodiment, electronic control circuit of the electronic latch ECU 67 and backup energy source 404 may be integrated into latch assembly 13. In the event of a failure in a main power supply from the main power source 400, electronic latch ECU 67 and/or swing door ECU 52 may be configured to supply power from the backup energy source 404 to power-operate door presenter assembly 602 for a presentment of the vehicle door 12 to the presented position.

In an illustrative example, the backup energy source 404 includes a group of low voltage supercapacitors (not shown) as an energy supply unit (or energy tank) to provide power backup to the power door actuation system 20 and/or the primary closure latch assembly 13, even in case of power failures. Supercapacitors may include electrolytic double layer capacitors, pseudocapacitors or a combination thereof. Other electronic components and interconnections of a backup energy source 404, such as a boost module to increase the voltage from the backup energy source 404 to an actuator, such as the power door presenter system 70 for example, are disclosed in co-owned U.S. Patent Publication US 2015/0330116.

Figure 5:
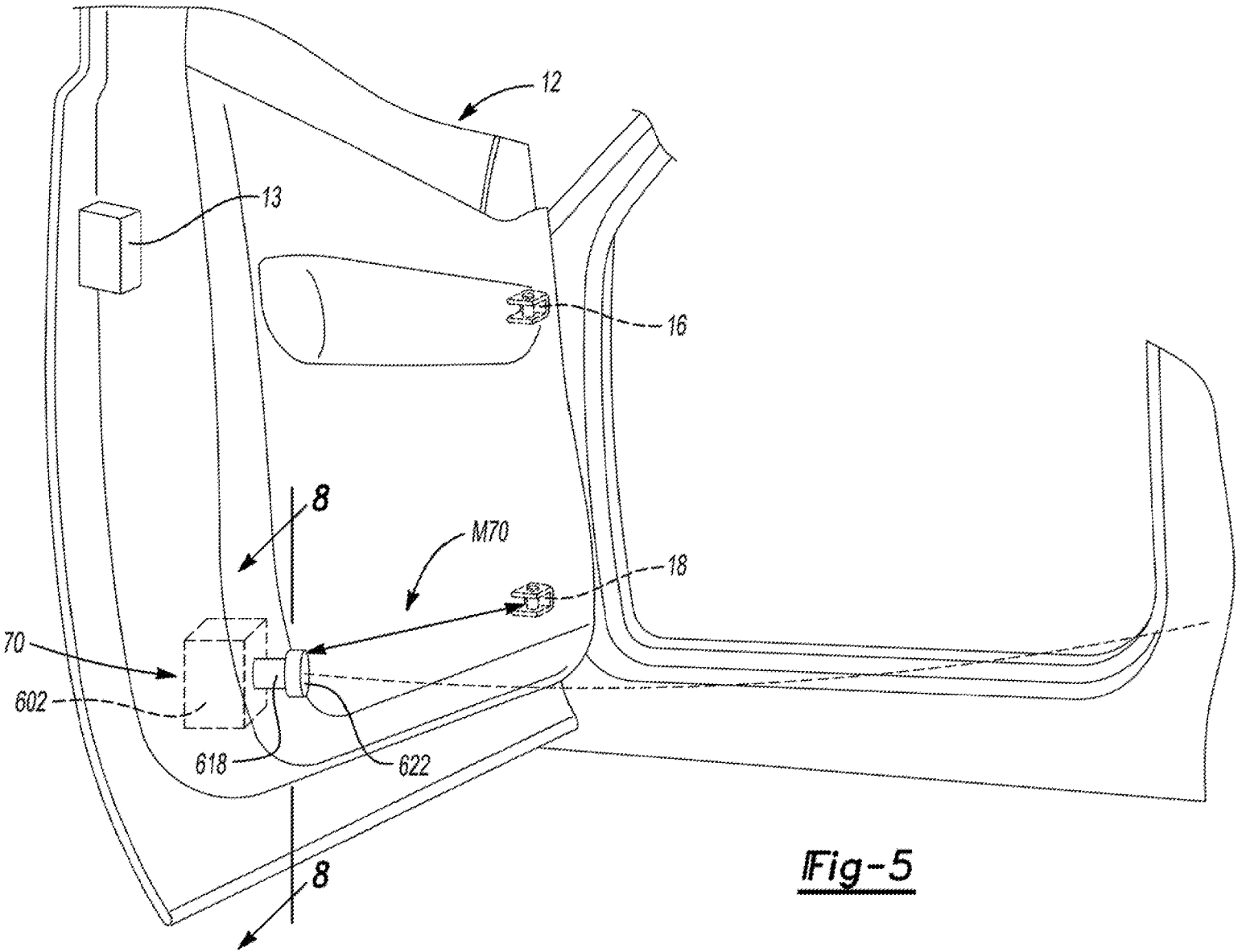
FIG. 5 illustrates the power door actuation system having a compact power door presenter assembly mounted to the vehicle door, in accordance with an illustrative embodiment.
Figure 6:
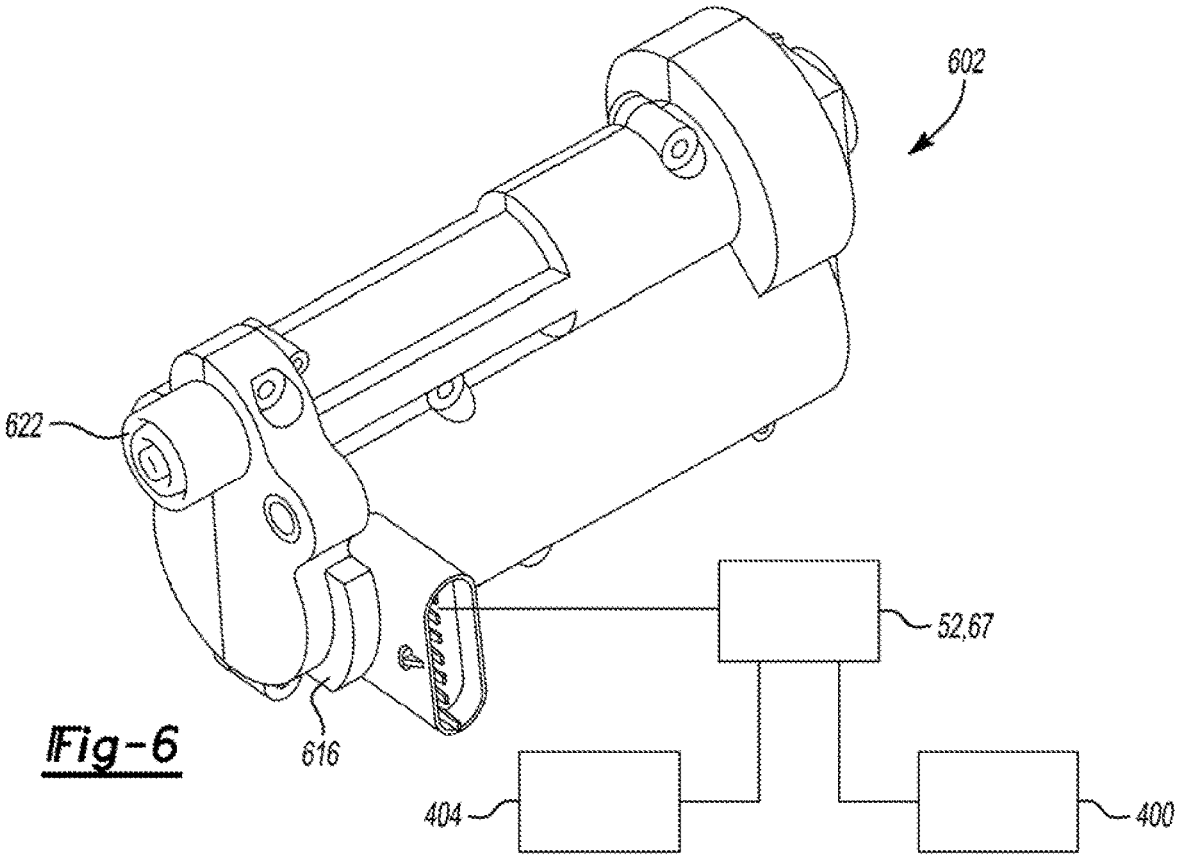
FIG. 6 is a perspective view of the presenter assembly of FIG. 5 in accordance with an illustrative embodiment.
Figure 7:
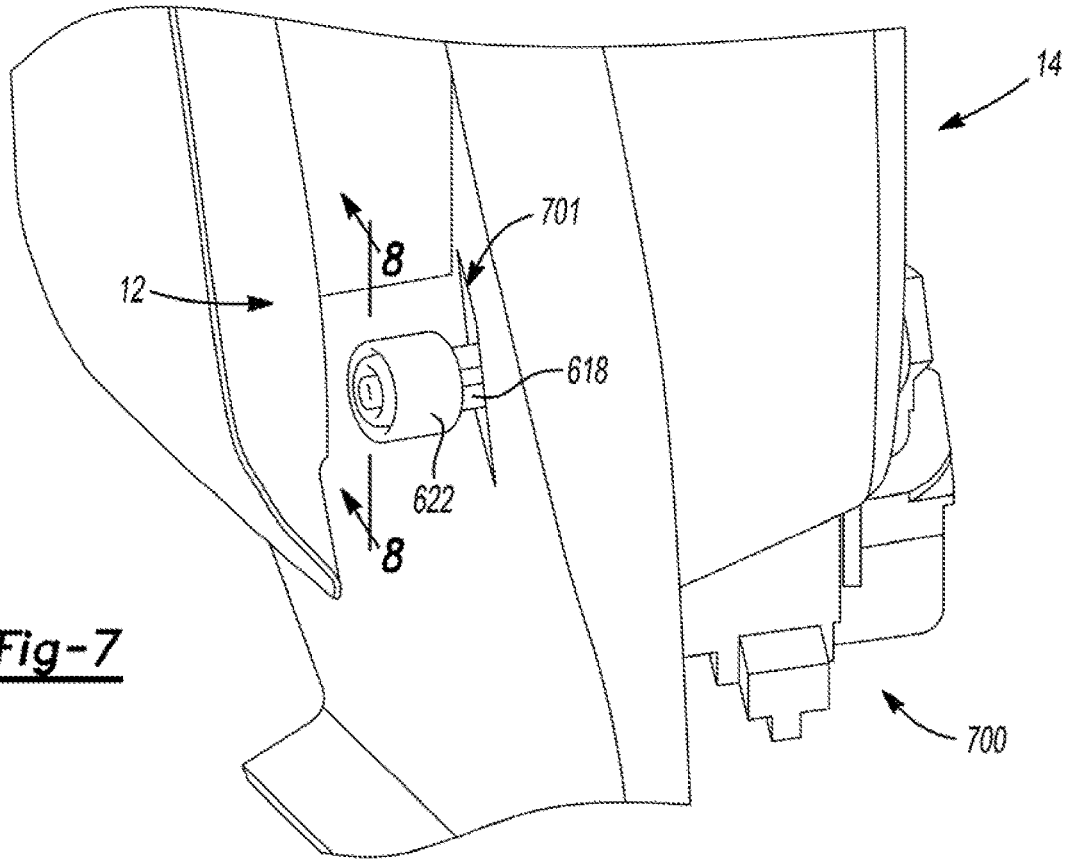
FIG. 7 illustrates the power door actuation system having a presenter assembly mounted to the vehicle body, in accordance with an illustrative embodiment.
Figure 8A:
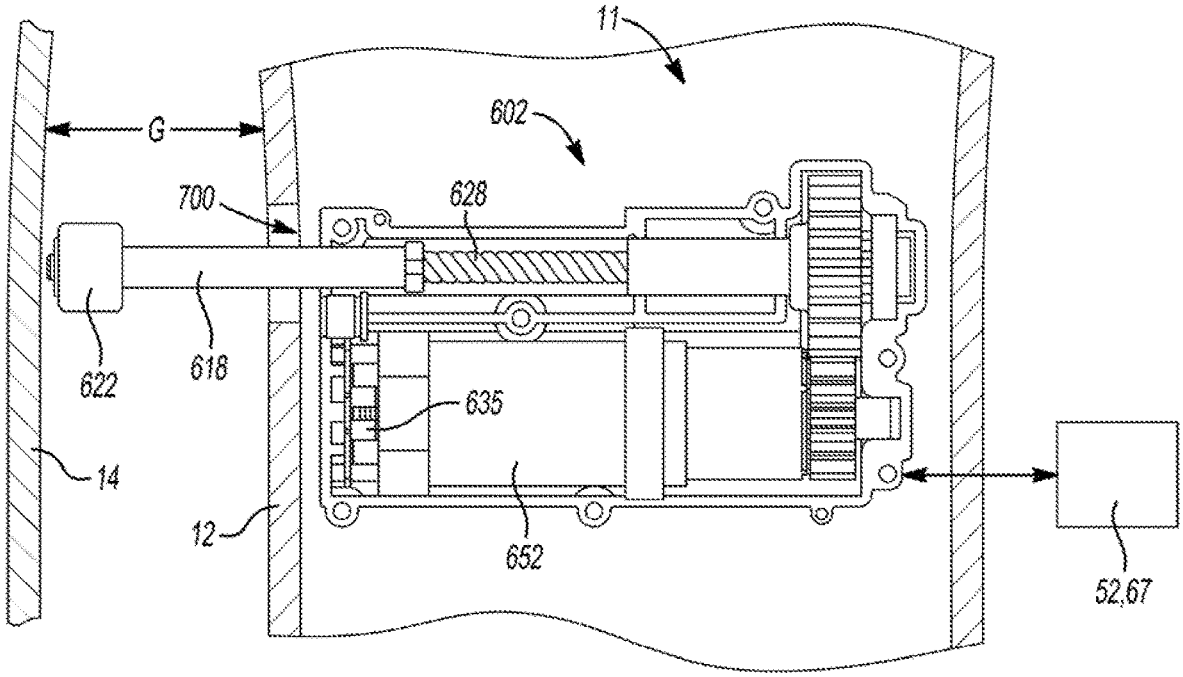
FIGS. 8A and 8B are cross-sectional views of the presenter assembly of the power door actuation system shown in FIG. 5 taken along the line 8-8 of FIG. 5, illustrating the door presenter assembly in a deployed or extended state, and a retracted state, respectively.
Figure 8B:
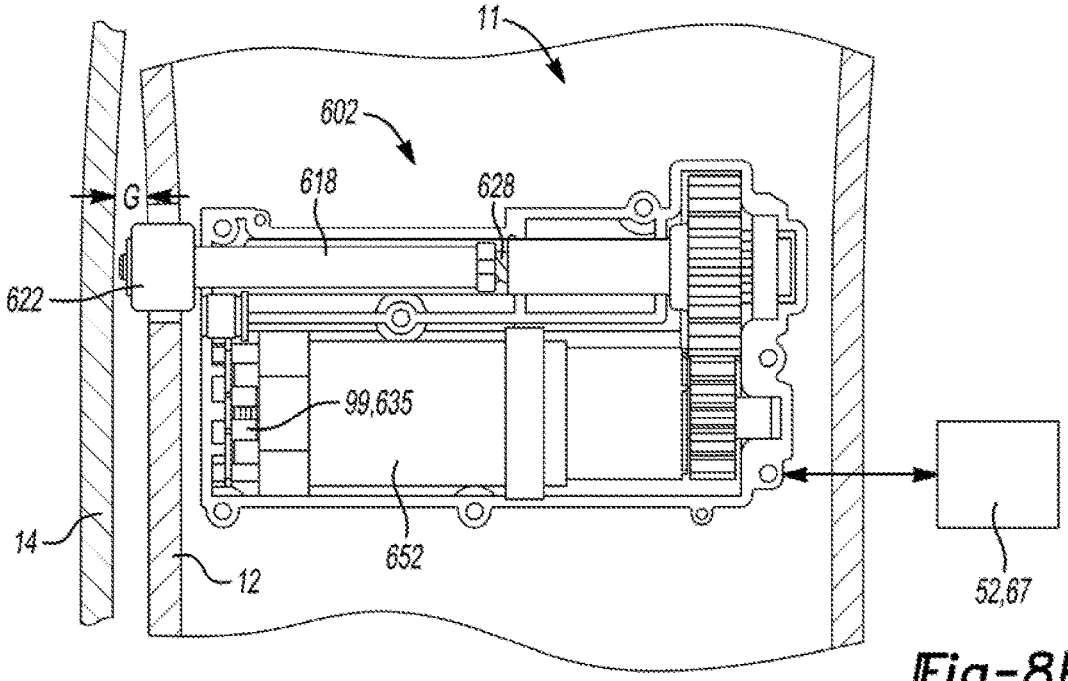
Figure 9:
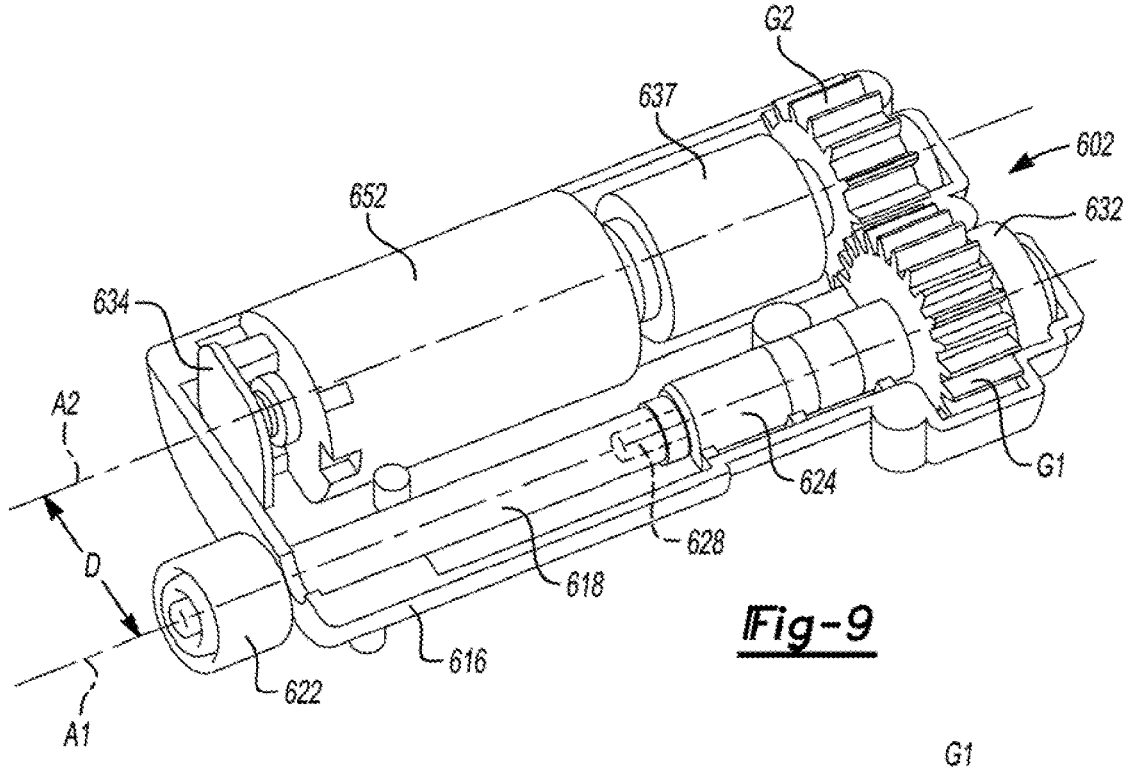
FIGS. 9 and 10 are perspective views of the presenter assembly of FIG. 6, having a housing cover removed to illustrate the various internal components.

Now referring to FIGS. 5, 7 and 9, in addition to FIGS. 1A and 2, in accordance with preferred configurations, a power door presenter system 70 (which can be configured for door 12 in conjunction with operation of the power-operated swing door actuator 22, or can be configured independently of the operation of power operated swing door actuator 22) generally includes a power-operated door presenter assembly 602 secured within an internal cavity 11 (e.g. for example within or adjacent a pillar 700 of vehicle body 14 as shown in FIG. 7 and therefore associated with vehicle body 14, or alternatively associated with passenger door 12 as illustrated in FIG. 5) and including an electric motor driving 652, and a drive mechanism having an extensible component 618 extendable through a port 701. Driven rotation of the drive mechanism causes controlled translation of the extensible component 618 which, in turn, controls pivotal movement of passenger door 12 relative to vehicle body 14 as the extensible component 618 abuts against the vehicle body 14 in the exemplary configuration of the power-operated door presenter assembly 602 being mounted to the vehicle door 12 as shown in FIG. 5, (or alternatively, the extensible component 618 abuts against the vehicle door 12 in the exemplary configuration illustrated in FIG. 7 showing the power operated door presenter assembly 602 mounted within the vehicle body 14). As such, it is recognized that location of the power-operated door presenter assembly 602 between vehicle body 14 and vehicle door 12 can be at any position, as shown by example or otherwise, as desired.

The power-operated door presenter assembly 602 of power door presenter system 70, as further explained below and as illustrated in FIG. 5, can be located at the bottom of door 12 below primary latch assembly 13 opposite to door hinges 16, 18. Alternatively, the presenter assembly 602 of power door presenter system 70 can be mounted to vehicle body 14 as illustrated in FIG. 7. Preferably, the power-operated door presenter assembly 602 can be located on the vehicle door 12 (or vehicle body 14) at a position away and opposite from the door hinges 16, 18 so as to gain mechanical advantage relative to the hinges 16, 18 thus requiring less force to open the vehicle door 12 from the closed position as would be required if the vehicle door 12 was acted upon at a position nearer the door hinges 16, 18, as is the case for the power-operated swing door actuator 22. Such mechanical advantage can be represented by a moment arm M70, where M70 may be greater than moment arm M22 depending on the location of the power door presenter system 70 relative to the hinges 16, 18.

Figure 11A:
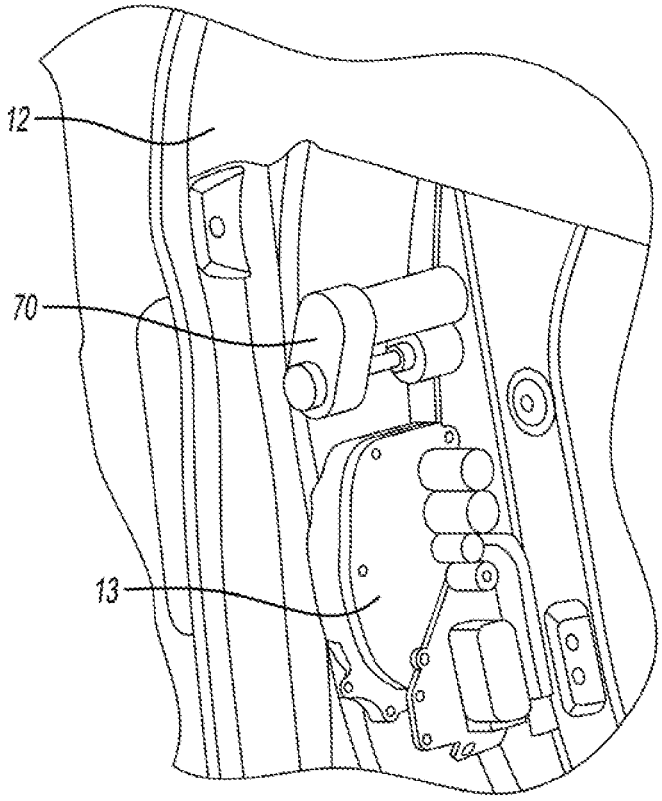
FIGS. 11A and 11B are transparent perspective views of the exterior of a vehicle door and the interior of the vehicle door, respectively, illustrating the positioning of the door presenter of FIG. 6 within the vehicle door, in accordance with an illustrative embodiment.
Figure 11B:
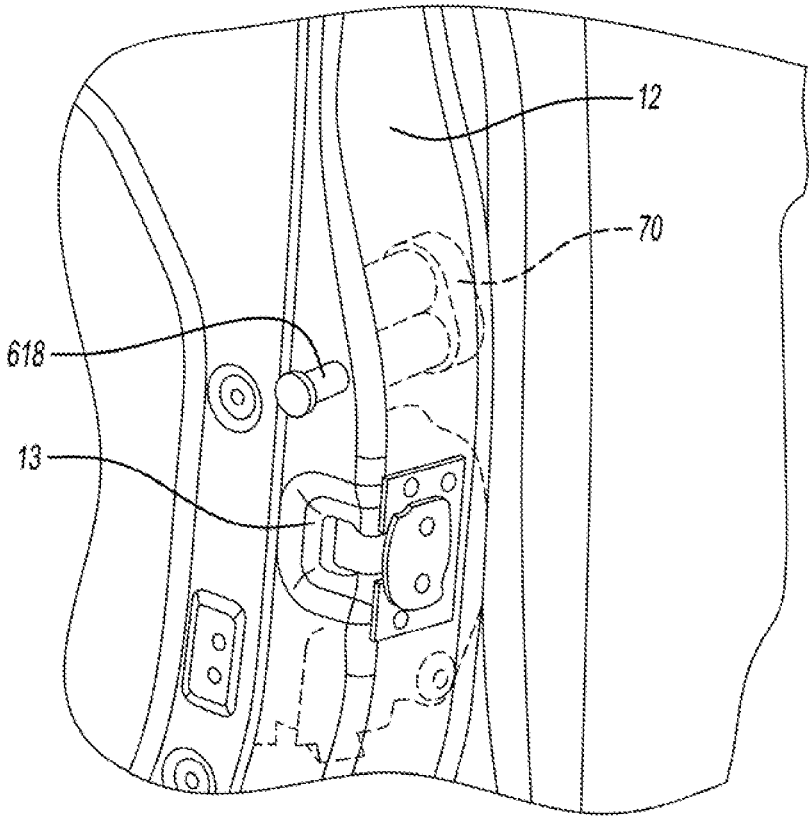

As shown in FIGS. 11A and 11B, an embodiment of power door presenter system 70 is positioned adjacent to a distal end of door 12 near the hem flange at a position above the primary latch assembly 13. Positioning the power door presenter system 70 opposite hinges 16, 18 provides a greater mechanical advantage for a door-moving action and allows exertion of a more effective moving force (e.g. 250 Newtons) or a greater moment arm on the door 12 as compared to the power swing actuator 22. Due to this mechanical advantage, a smaller motor 652 may be employed requiring less power to operate, and correspondingly a smaller back up energy source 404 may therefore be provided to operate the power door presenter system 70 to present the door 12 in the event of a power failure of the main power source 400. Further, due to this increase in mechanical advantage, the power operated door presenter assembly 602 can provide ice breaking functionality as well as assist with the movement of the door 12 in a post-crash condition, where for example the door 12 may be damaged and thus seized or jammed relative to the vehicle body 14 and thus requiring a greater than normal opening force to overcome this state. FIG. 11B illustratively shows extensible member 618 projecting away from the inner sheet metal panel 110 in a perpendicular configuration, it is further recognized that extensible member 618 may project at an angle relative to the inner sheet metal panel 110.

As a result, a smaller more compact and lower energy consuming electric motor 652 can be provided, as well as a more compact, less costly, lower weight, back-up energy source 404 due to the lower energy requirements of the power-operated door presenter assembly 602 required to effectuate a movement of the door 12 from a closed position to a presented position. Also, the power door actuation system 20 can now be operated as follows: since power door presenter system 70 can provide for a partial open/close movement, or presentment, of door 12, the power-operated swing door actuator 22 can be deactivated during such movement of the door, and activated after the presentment for either continued movement or door checking functionality. Since the power door presenter system 70 now assumes the task of overcoming the initial high torque movement the power-operated swing door actuator 22 would normally assume if operating without coordination with the power door presenter system 70, the motor 24 can be reduced in size providing cost and weight savings. As a result, a less powerful electric motor 24 can be provided with the power-operated swing door actuator 22 as the power-operated swing door actuator 22 may be controlled to subsequently operate to move the door 12 from the presented position to other partially opened or fully opened positions whereat the mechanical advantage for the power-operated swing door actuator 22 is greater than when the door 12 is in its closed position. Alternatively, the power-operated swing door actuator 22 and the power door presenter system 70 can be operated in conjunction to present the door 12. As such, actuation of power door presenter system 70 can provide for coordinated and controlled presentment and opening of door 12 in conjunction with power-operated swing door actuator 22.

While the door 12 can be employed as part of a door system including an outside door handle 61, the power door presenter system 70 can be employed for coordinated and controlled presentment of door 12 to a user requesting opening of the door 12 in the configuration of the door 12 without a door handle, for example having a proximity sensor 61*c* in lieu of an outside door handle 61. In such a configuration, the presentment of door 12 would be sufficient to move the door 12 away from the vehicle body 14 so that the fingers of the user exterior the vehicle 14 can be slipped between the vehicle body 14 and the door 12 to grasp, for example about door edge 69 as illustratively shown at possible handle regions 69*a* and 69*b* in FIG. 1B, and to subsequently pull the door 12 to open it. The power door presenter system 70 can also be employed for coordinated and controlled presentment of door 12 to a user requesting opening of the door 12 using inside door handle 61*a*. In all configurations, the presentment of door 12 may be sufficient to move the door 12 away from the vehicle body 14 to break through any ice build-up 89 on door 12 and vehicle body 14 tending to prevent a door 12 from easily opening i.e. acting as an ice breaker function. In all configurations, the presentment of door 12 would be sufficient to move the door 12 away from the vehicle body 14 overcoming the larger force moments required to move the door 12 from the closed position to the presented position as would be required to be overcome by the power-operated swing door actuator 22 operating without the coordination of power door presenter system 70.

Now referring back to FIG. 2, illustrated are one or more sensors 71 communicating with swing door ECU 52 for providing requisite information. It is recognized that sensors 71 can be any number of sensor types (e.g. Hall sensor, presence sensors such as anti-pinch strips, capacitive, ultrasonic, radar, mechanical switches, location sensors, etc.). Although not expressly illustrated, electric motor 24 of power-operated swing door actuator 22 can include sensors for monitoring a position of vehicle door 12 during movement between its open and closed positions. As is also schematically shown in FIG. 2, swing door ECU 52 can be in communication with remote key fob 60 via a fob transreceiver module 600 or an internal/external handle switch 63, 63*a*, or proximity sensor 61*c* for receiving a request from a user to open or close vehicle door 12. Put another way, swing door ECU 52 receives a command signal from either remote key fob 60 and/or internal/external handle switch 62, and/or proximity sensor 61*c* to initiate an opening or closing of vehicle door 12. It is also recognized that a body control module 72 (having memory with instructions for execution on a computer processor) mounted in vehicle body 14 of vehicle 10 can send the open or close request to swing door ECU 52 and electronic latch ECU 67.

It is recognized that other than outside handle switch 63, swing door ECU 52 can be in communication with a number of other sensors 99 in the vehicle including in power-operated swing door actuator 22, in power door presenter system 70, and in primary latch assembly 13. For example, the switches of primary latch assembly 13 can provide information to latch ECU 67 as well as swing door ECU 52 (i.e. the switches provide positional information to swing door ECU 52 of the location/state of door 12 with respect to position at or between the fully closed or latched position, secondary or partially closed and the partially open or unlatched position). For example, the sensors of door presenter assembly 602 can provide information to latch ECU 67 as well as swing door ECU 52 (i.e. the sensors provide positional/operational information to swing door ECU 52 of the location/state of extensible member 618 of the door presenter assembly 602 with respect to position at or between the fully deployed or retracted position, or there in between, or motor operation such as speed, current draw, etc.). Obviously, a single ECU can be used to integrate the functions of door ECU 52 and latch ECU 67 into a common control device located anywhere within door 12, or vehicle body 14.

Swing door ECU 52 can also receive an additional input from a proximity sensor 64 (e.g. ultrasonic or radar) positioned on a portion of vehicle door 12, such as on a door mirror 65, or the like, as shown in FIG. 1A. Proximity sensor 64 assesses if an obstacle, such as another car, tree, or post, is near or in close proximity to vehicle door 12. If such an obstacle is present, proximity sensor 64 will send a signal to swing door ECU 52, and swing door ECU 52 will proceed to turn off electric motor 24 and/or electric motor 652 to stop movement of vehicle door 12, and thus prevent vehicle door 12 from hitting the obstacle.

A non-limiting embodiment of power door presenter system 70 will now be described with reference to FIGS. 5 through 13 to generally include a power door presenter assembly 602. In general, power door presenter assembly 602 is adapted to be rigidly secured to vehicle body 14 or the vehicle door 12, such as by securing a housing 616 encapsulating the various components of the power presenter assembly 602 as will be further described herein below.

In FIGS. 6 to 10, a non-limiting embodiment of a power door presenter assembly 602 is shown. The power door presenter assembly 602 has a housing 616 defining a cylindrical chamber in which an extensible member 618 slides. The extensible member 618 can be configured having an external distal end as discussed for any of the above embodiments, and is shown, by way of example and without limitation, as having a bumper, such as an elastic bumper 622 for abutment with the vehicle body 14. The power swing door assembly 602 further includes an internally threaded cylindrical tube 624 which is rotatably connected to a lead screw 628 connected to a proximal end of the extensible member 618. The lead screw 628 is threadingly matable with the internally threaded cylindrical tube 624, also referred to as nut tube or nut 624, to permit relative rotation and translation between lead screw 628 and the nut tube 624. The extensible member 618 is non-rotatably and axially moveable on leadscrew 618 between a retracted position (FIGS. 8B and 10) and an extended position (FIGS. 8A and 12) relative to housing 616. When extensible member 618 is located in its extended position (FIGS. 8A and 12), door 12 is urged into a partially opened deployed or "presented" position. The configuration of the lead screw 628 and nut 624 i.e. the thread pitch angles and geartrain unit are such so as to provide a manual reversibility of extensible member 618 from the deployed position to its retracted position, for example by urging the extension member 618 towards its retracted position by a closing of the door 12 abutting the elastic bumper 622.

Figure 10:
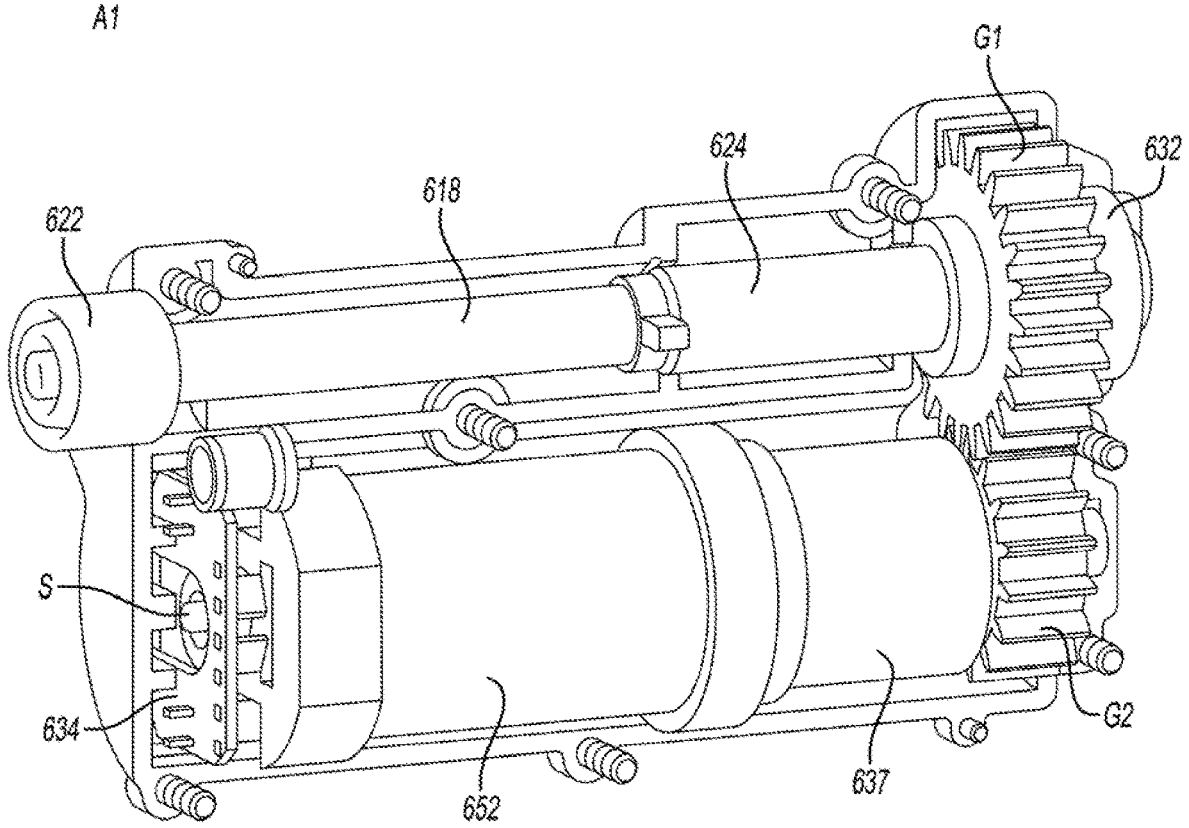
Figure 12:
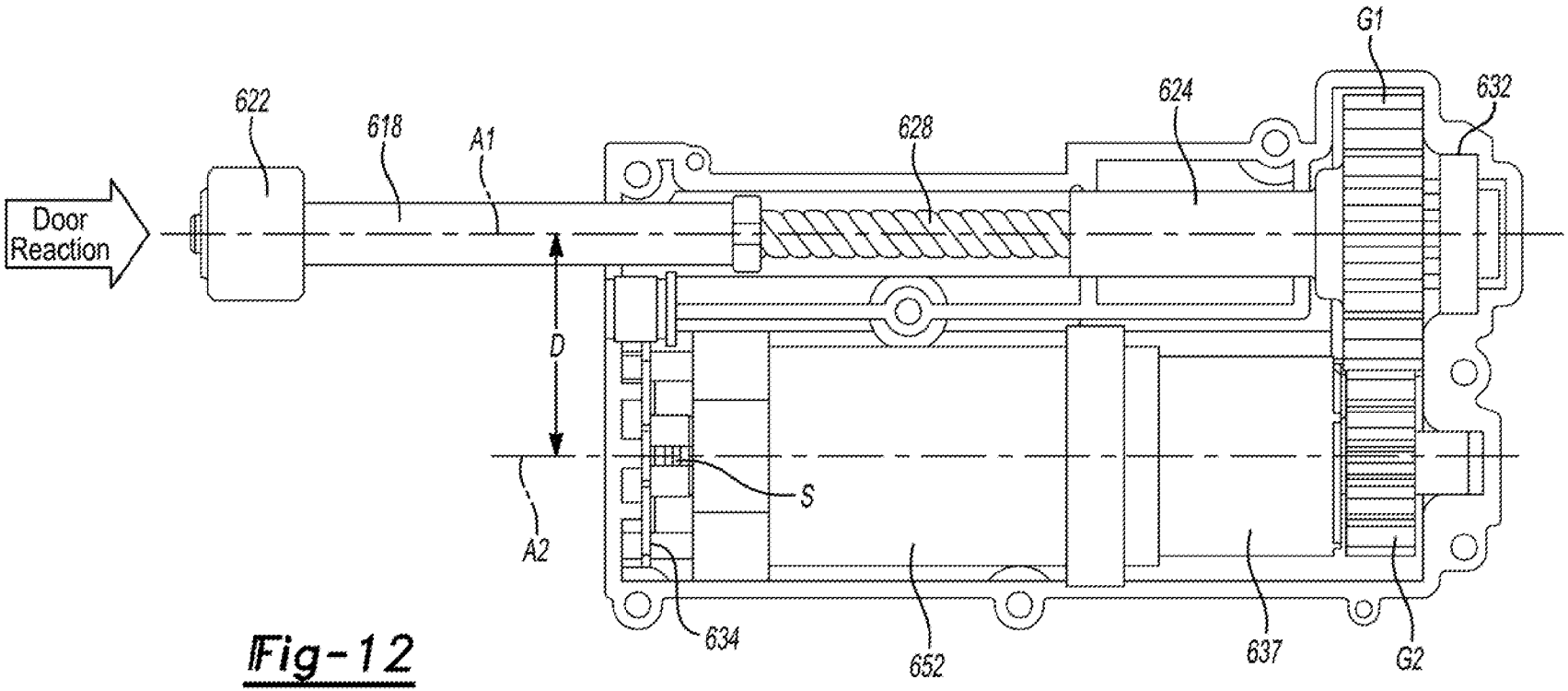
FIG. 12 is a view similar to FIG. 8A with the extensible member thereof shown in an extended state, illustrating the application of a force to return the extensible member to a retracted position.

In the embodiment shown in FIGS. 10 and 12, because the nut tube 624 is fixedly attached to a driven gear G1 for rotation in the housing 616 but is prevented from linear translation, as the driven gear G1 rotates in meshed engagement with a drive gear G2 in response to selective actuation of a motor 652, the nut tube 624 rotates, thereby causing the lead screw 628 and extensible member 618 fixed thereto to translate linearly along a first axis A1, causing the extensible member 618 to move with respect to the housing 616. Since the extensible member 618 is configured in this illustrated embodiment for abutment with the vehicle body 14 and the housing 616 is connected to the door 12, movement of the extensible member 618 causes the door 12 to pivot relative to the vehicle body 14. The lead screw 628 and the nut tube 624 thereby define a spindle-type rotary-to-linear conversion mechanism.

The lead screw 628 is rotatably connected to the nut tube 624 that is journaled in the housing 616 via any suitable bearing 632 that provides radial and linear support for the nut tube 624. A PCB 634 with sensor, such as a Hall-effect sensor 635, by way of example and without limitation, is mounted about a shaft S of the motor 652. The sensor 634 can detect motor shaft rotations and convert detected rotations into an absolute linear position electrical signal so that the linear position of the extensible member 618 is relatively known. In alternative embodiments, the sensor 634 can be provided as discussed above, such by a linear encoder which reads the travel between components that move relative to one another, so that the linear position of the extensible member 618 is known with certainty, even upon power up.

The motor shaft S is connected to a geartrain unit, also referred to as planetary gear box 637 for providing a gear reduction between the motor shaft S and the drive gear G2. The gear box 637 may be operably connected to a clutch unit that is normally engaged and can be energized to disengage to facilitate reversal of door presenter assembly. Further discussion here with regard to the clutch unit, given the discussion above, is believed unnecessary.

The motor 652 and the extensible member 618 are packaged within the housing 616 to provide a compact assembly having a minimal outer envelope, and in particular a minimized length (when compared to a configuration having the extensible member 618 and the motor 652 in a series arrangement having their longitudinal axes aligned), thereby requiring reduced space in which to mount the power swing door assembly 602. For example, in mounting positions in the vehicle door 12, the width of the door 12 can be correspondingly reduced due to the compact length of the power swing door assembly 602 (e.g. approximately half when compared to a series arrangement). In an illustrative embodiment, housing 616 may be integrally formed with the housing of latch assembly 13, such that integrated power door presenter assembly 602 is integrated within latch assembly 13 (e.g. share the same housing for easy installation into the vehicle door 12 as a single unit). To provide the minimal outer envelope of the housing 616, the motor shaft S is oriented to extend along a second axis A2 that is parallel or substantially parallel (meaning that the axes A1, A2 may be slightly off parallel, such as by a few degrees) with one another. Further, the motor 652 and extensible member 618 are immediately adjacent, that is side by side, one another in laterally aligned and spaced relation by a distance D equal to the sum of the radii of the driven gear G1 and drive gear G2. Providing the axis of the motor 652 not co-axial or not concentric with the axis of extensible member 618 in a configuration whereby the longitudinal length of the actuator would be the sum of the longitudinal lengths of the motor 652 together with the extensible member 618 as an example showing in FIG. 3A, results in the reduction of the longitudinal length of the power-operated door presenter assembly 602, allowing the power door presenter system 70 to be packaged in a widthwise direction within vehicle door 12 without requiring any vertical packaging space above or below the power door presenter system 70 when installed in the door, as a configuration in FIG. 4 would require. Providing the extensible member 618 and motor 652 in a non-concentric and adjacent arrangement results in a further reduction of the longitudinal length of the power-operated door presenter assembly 602.

With reference to FIG. 12, the motor shaft S extends away from the motor 652, for example to the right in FIG. 12, along the second axis in a first direction, illustrated as arrow D1, and the extensible member 618 is moveable from the retracted position to the extended along the first axis in a second direction illustrated as arrow D1 pointing towards the left, different than the first direction 1D. Illustratively, the motor 652 and the extensible member 618 are positioned adjacent one another in a side by side configuration on the same common side (e.g. on one side, that is the left side) of the gears G1, G2. Gears G1, G2 form a gear train or transmission train 631 configured to transmit torque from the motor shaft S to the extensible member. Optionally the gear train 631 may be configured to be back driveable to transmit torque from the extensible member to the motor shaft, for example via rotation of the nut tube 624 imparted by a linear movement of the extensible member, illustratively towards the right in FIG. 12.

Upon receiving a present command, swing door ECU 52 can provide a signal to electric motor 652 in the form of a pulse width modulated voltage (for speed control) to turn on motor 652 and initiate pivotal opening movement of vehicle door 12 towards its partially open deployed position (i.e. presented position) (recognizing that primary latch assembly 13 is already in its unlatched state as further discussed below) via extension of extensible member 618. While providing the signal, swing door ECU 52 can also obtain feedback from sensors 64,71 to ensure that contact with an obstacle has not occurred or occurring as would be the case if an object or person is leaning upon the vehicle door 12 or otherwise that the user is present (e.g. is manually in charge of door 12). If no obstacle is present, motor 652 will continue to generate a rotational force to actuate spindle drive mechanism and thus extension of extensible member 618 until certain door positions are reached (e.g. 50 mm open position) or otherwise indicate that the user is present (e.g. hand is on the presented door 12 at the handle regions 69*a* and 69*b* for example). Once vehicle door 12 is positioned at the desired location, motor 652 is turned off. The user may then take control of door 12, or the vehicle door 12 can be automatically opened by swing door ECU 52 commanding power-operated swing door actuator 22. Otherwise, upon signaling of manual control of door 12 by the user, the extensible member 618 may be retracted by door ECU 52 actuating the motor 652 in the reverse direction. In the case of a power failure, the extensible member 618 may be easily retracted by a user closing the door to urge the extensible member to its retracted position. Swing door ECU 52 may control both power-operated door presenter assembly 602 and power-operated swing door actuator 22 in a coordinated manner. For example, swing door ECU 52 may control power-operated door presenter assembly 602 over a first range of motion (e.g. from a fully closed to a presented position of the vehicle door 12), and then swing door ECU 52 may control power-operated swing door actuator 22 over a second range of motion during which power-operated door presenter assembly 602 is not powered. In another example swing door ECU 52 may control both power-operated door presenter assembly 602 and power-operated swing door actuator 22 over a first range of motion (e.g. from a fully closed to a presented position of the vehicle door 12) to provide for increased door moving force to overcome ice buildup 89, or to overcome the inherent high torque requirement for moving the door 12 from the closed position due to the small moment arm M22. As a result both the motor output, power requirements and therefore size of power-operated swing door actuator 22 and power-operated door presenter assembly 602 may be reduced, as both will be operating in tandem, and in particular since power-operated door presenter assembly 602 will be acting at leveraged position on vehicle door 12 away from the hinges 16, 18 thereby gaining mechanical advantage compared to the more closely coupled swing door actuator 22. The user may then take control of door 12, or the vehicle door 12 can be automatically opened by swing door ECU 52 commanding power-operated swing door actuator 22.

Method

Figure 13:
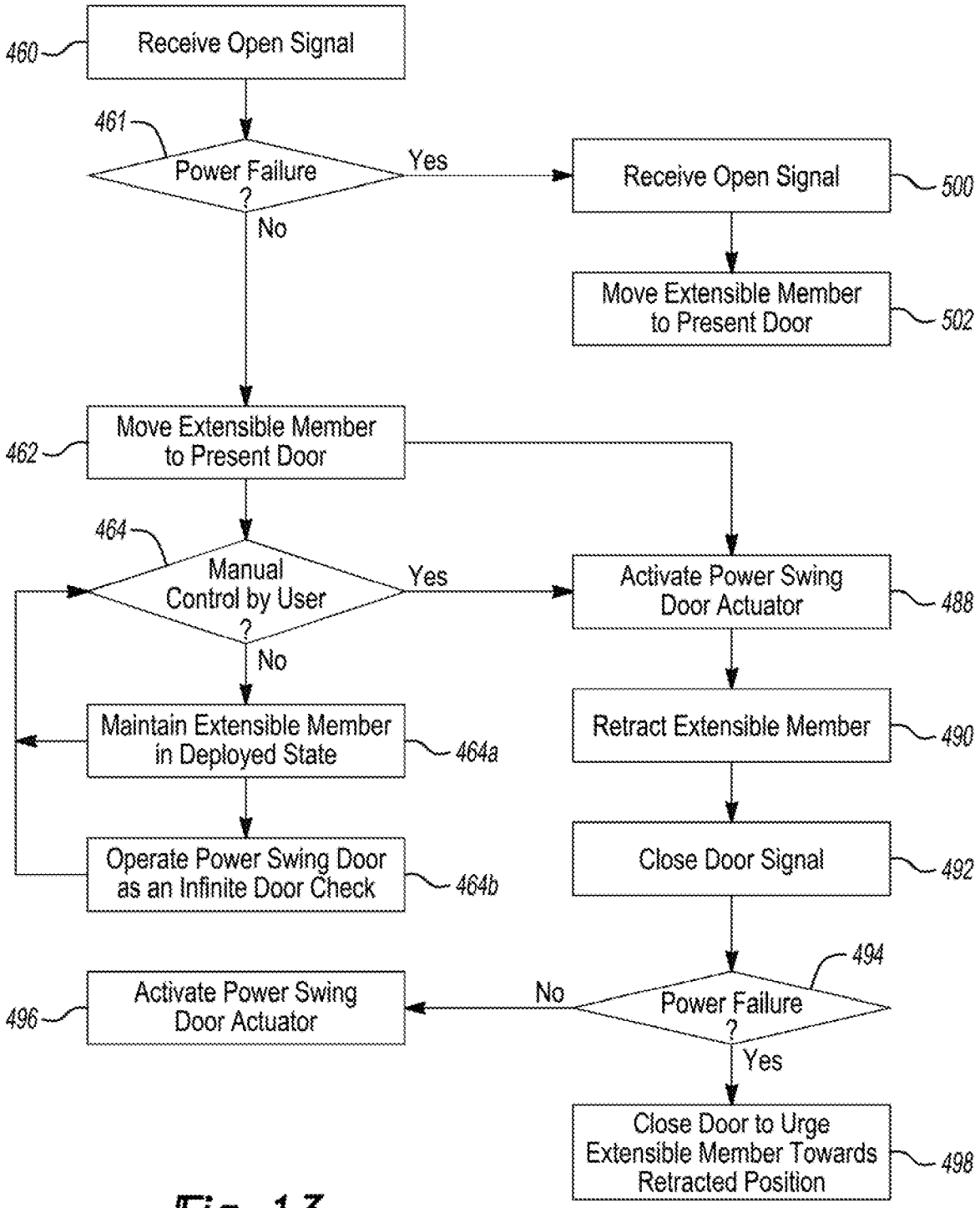
FIG. 13 is a flowchart for operation of the power door presenter system in accordance with an illustrative embodiment.

An example operation of the embodiment of power door presenter system 70 to present the door 12, which could include only operation of the power-operated door presenter assembly 602 operating to move the door 12 in lieu of power-operated swing door actuator 22, if desired, is shown in the flowchart of FIG. 13.

Specifically, at step 460, latch controller 67 or swing door ECU 52 (or by another vehicle control module—not shown) receives a signal for opening of door 12 e.g. via a door handle/button operation, key fob, or a proximity sensor activation). Latch controller 67 or swing door ECU 52 (or by another vehicle control module—not shown) sends a signal to the door presenter assembly 602 to cause actuation of the motor 652. The swing door ECU 52 (or other vehicle control module, ECU 67 for example) can also command release of the primary latch assembly 13 while holding primary latch assembly 13 in its unlatched state until resetting of the power door presenter system 70 once striker 37 leaves the fishmouth. Holding the primary latch assembly 13 in the unlatched state allows the striker 37 to remain disengaged from the ratchet 21 for movement from the fishmouth of primary latch assembly 13 when extensible member 618 pushes striker 37 out of the fishmouth of primary latch assembly 13 due to further extension of the extensible member 618 in subsequent steps. Optionally, the latch controller 67 or swing door ECU 52 (or by another vehicle control module—not shown) may send a signal to power-operated swing door actuator 22 to cause actuation of the motor 24 in tandem (e.g. simultaneously) with operation of the motor 652, as in step 488. Alternatively, the swing door ECU 52 (or other vehicle control module, ECU 67 for example) can also command release of the primary latch assembly 13 subsequent the next step 462 now described below. Delaying release of the primary latch assembly 13 may allow the extensible member 618 time to move from its retracted position to a partially presented position for immediate action upon the vehicle door 12 after a power release command is issued to the primary latch assembly 13. This may reduce the likelihood of the pawl 23 returning to a ratchet holding position after having been moved to the striker release position in response to a power release command, which may assist in the scenario where any seal load tending to pull the striker 37 out of the fishmouth is negated, for example as a result of an ice buildup 89 between the vehicle door 12 and the vehicle body 14, not resulting in the ratchet 21 moving out of its striker capture position and into a state where the pawl 23 is not able to reengage the ratchet 21 in the ratchet holding position under influence of the pawl biasing member 49. As a result, the pawl 23 would be reengaged with the ratchet 21 subsequent a power release such that upon actuation of the extensible member 618 to engage with the vehicle door 12, the door 12 will be secured to the vehicle body 14 by the latch assembly 13, resulting in the door not being moved to the presented position. Delaying release of the primary latch assembly 13 at a moment when the extensible member 618 has already moved from its retracted position to a partially deployed position (see FIG. 15) adjacent (e.g. at a subsequent moment), or in contact (e.g. at a simultaneous moment) with the vehicle door 12 will provide for the either an additional force on the ratchet 21 simulating a seal loading, or allow for the ice buildup 89 to be overcome by movement of the door 12 due to urging of the extensible member 618 thereupon to assist the seal load to subsequently act upon the striker 37 to disengage the ratchet 21 and prevent the pawl 23 from reengaging with the ratchet 21 subsequent a power release.

At step 462, and if no power failure of the main power supply 400 has been detected at step 461, the extensible member 618 may be deployed from its retracted position to move the door 12 to a presented position. It is recognized that at step 462, primary latch assembly 13 is released (e.g. via a powered or manual release) in order for door 12 to be moved by the power door presenter system 70. At step 462, the extensible member 618 will be deployed from its retracted position operable to "present" the door 12 by opening it (i.e. by contacting the bumper 622 on either the vehicle door 12 or the vehicle body 14 to impart a reactive opening force on the vehicle door 12) only by a predetermined amount (such as, for example, 30-50 mm) from a closed position to a partially-open, presented, position so as to allow subsequent manual movement of the door to its fully-open position. During the presentment operation, the power door presenter system 70 may also provide an ice breaker force to break through any ice build-up around the door 12 and vehicle body 14 which may prevent the door 12 from moving away from its closed position and which may seize the door 12 shut and be difficult to overcome for a user within the passenger compartment 7.

Once presented, at step 464, swing door ECU 52 waits for a specified period of time to receive a signal from the sensors representing that the user has control (e.g. is manually moving) of door 12. Also, at this time and at step 464, swing door ECU 52 can start polling sensors (e.g. Adjustable Pressure Switch (APS) or other sensing technology) for a manual opening of door 12 by the user and thereby continue checking throughout the extension of extensible member 618. In this case, the sensors to detect manual control can be an anti-pinch strip type sensor that runs the periphery of the door 12 and is activated by contact when manually grabbing door 12, e.g. activation of a manual switch or pressure sensor or other sensing technology or via a capacitive, optical, ultrasonic, or other contact or non-contact sensor can also be used.

Further, once the extensible member 618 is deployed and the door 12 is in the open position, at step 464*a*, electric motor 652 is not actuated and power door presenter system 70 remains in the deployed state (i.e. door is presented), thus facilitating opening of door 12 manually by the user i.e. (the door 12 has been sufficiently moved so as to create a gap G (see FIG. 8A) between the door 12 and the vehicle body 14 to allow the users fingers sufficient space to insert and grasp handle regions 69*a* and 69*b* shown in FIG. 1B, to subsequently pull the door 12 to open it. Also, by maintaining the extensible member 618 in is deployed (e.g. operating the motor 652 in a stall condition, with continuous supply of power), the safety feature of ensuring the users fingers don't get pinched between the door 12 and the vehicle body 14 is provided (i.e. blocking action of the power door presenter system 70), in the case of a gust of wind, vehicle parked on a slope, or otherwise tending to urge the door 12 closed.

Further, at step 464*b*, and before detection that a user has control of the door 12, the swing door ECU 52 signals to power-operated swing door actuator 22 to operate as an infinite door check (e.g. to a first check link detent position measured at for example 50 mm from the pillar to the trailing edge of door 12). In this case, the extensible member 618 may be retracted, or its stall condition interrupted, since the door check will provide the safety feature.

At step 464, if the presence of the user is sensed by the sensors before the door 12 has reach its presented position (i.e. extensible member 618 not fully retracted), the user can manually open door 12 to a desired door check position and swing door ECU 52, at step 490, sends a signal to electric motor 652 to retract extensible member 618 back to its home position (e.g. retracted position), as the user is manually opening door 12, and optionally command power-operated swing door actuator 22 at the desired door check position to operate as an infinite door check at this position. During normal operation, the extensible member 618 returns to the retracted position prior to closing of the door 12 by the user (for example, extensible member 618 return time is less than the time for a user to enter the vehicle 10 and close the door 12) for ease of door closing. In the event that the extensible member 618 is not in the fully retracted position, and the user decides to close the door 12 before it has reached its deployed position, the system is easily back drivable as described above so as not allow a user to sense any impediment or obstacle of the extensible member 618 in the closing of the door 12. Providing an easily back drivable power door presenter system 70 also allows the door 12 to be manually closed (e.g. the extensible member 618 may be manually forced into its retracted position) in the event a power failure results in the extensible member 618 not being able to be powered back to its retracted position.

Optionally, as step 488, the swing door ECU 52 may send a signal to power-operated swing door actuator 22 to commence its power opening operation at step 488 to automatically open the door 12 without a further manual intervention of the door (i.e. an initial grasping of the door by a user activates further power opening), for example upon the sensors sensing that a brief manual control over the door 12 has been made.

Optionally, as step 488, the swing door ECU 52 may send a signal to power-operated swing door actuator 22 to stop its power opening operation to apply an infinite door check function at that position where a user releases his grasp of the door 12, for example upon the sensors sensing that a brief manual control over the door 12 has been terminated.

Upon closing of door 12 by the user (e.g. manually) at step 492, in order to close primary latch assembly 13, striker 37 would once again become engaged with ratchet 21 (i.e. reset ratchet 21 such that ratchet 21 is held by pawl 23 and striker 37 is retained by ratchet 21 in the fishmouth 436. Also, extensible member 618 would be in its retracted position so as not to impede the closing of the door 12. Accordingly, power door presenter system 70 is already in a state to be redeployed upon a subsequent Receive Open Signal 460 step. At Step 496, power operated swing actuator 22 may provide for a powered or automatic closing of the door 12. If a power failure presents such an automatic closing, the power door presenter system 70 is easily back drivable as described above so as to ensure the extensible member 618 does not prevent the door 12 from being closed.

If at step 461, a power source failure has been detected, for example as would be the case of an emergency crash condition, the power door presenter system 70 can be activated to allow the door to be presented using the backup emergency power source 404 to allow thereafter the user to gain manual control of door 12 once presented. As such, if at step 500 a door open signal is received, then swing door ECU 52 signals electric motor 526 to deploy extensible member 618 using the energy from the back up energy source 404 at step 502. Thus the door 12 can be opened under an emergency condition in the case a physical door handle, such as outside door handle 61, is not installed on the vehicle 10. Also, the power door presenter system 70 can assist a user (interior or exterior the vehicle 10) with overcoming any damage to the door 12 and/or vehicle body 14 sustained during the accident which would tend to bind the door 12 closed.

The power door presenter systems shown in FIGS. 5-12 thus demonstrates an arrangement for providing a door presenter functionality to move the door from its closed position to its partially-open deployed, or presented, position. The door may be subsequently grasped by a user to move the door from its deployed position to its fully-open position, either during a normal door opening request, an emergency crash situation, or a failure of the main vehicle power source. While not limited thereto, the power-operated door presenter assembly 602 is capable of providing a range of swinging deployment of about 30-50 mm to meet current door system requirements.

Figure 14:
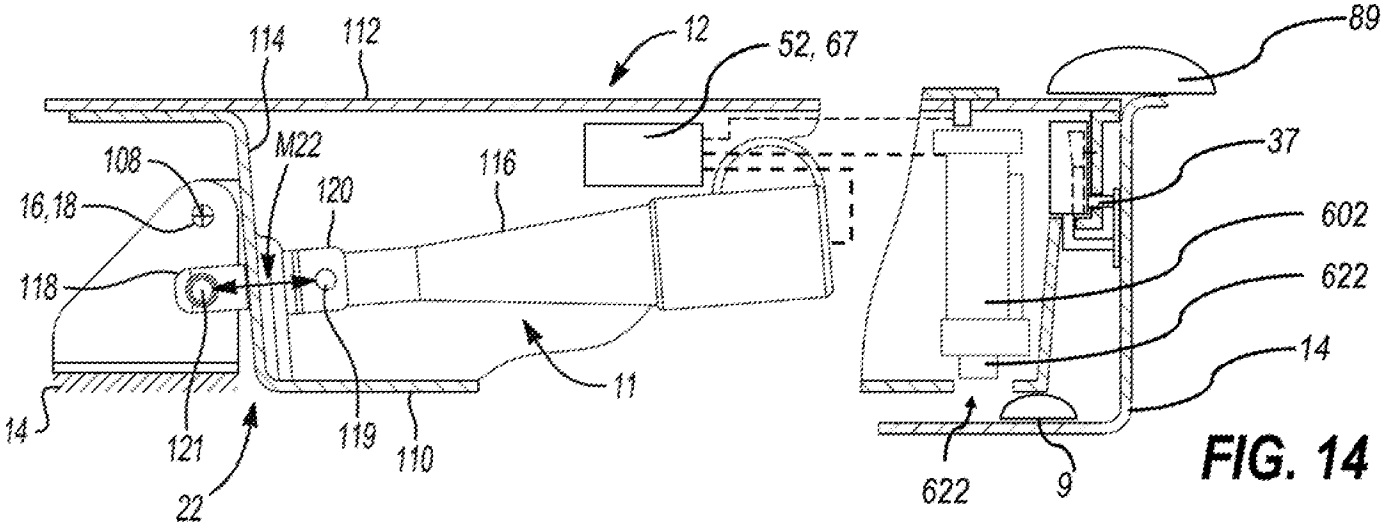
FIGS. 14 to 16 are schematic views illustrating the presentment of a vehicle door using a compact power door presenter assembly, alone or in conjunction with operation of a power swing door actuator, in accordance with an illustrative embodiment.
Figure 15:
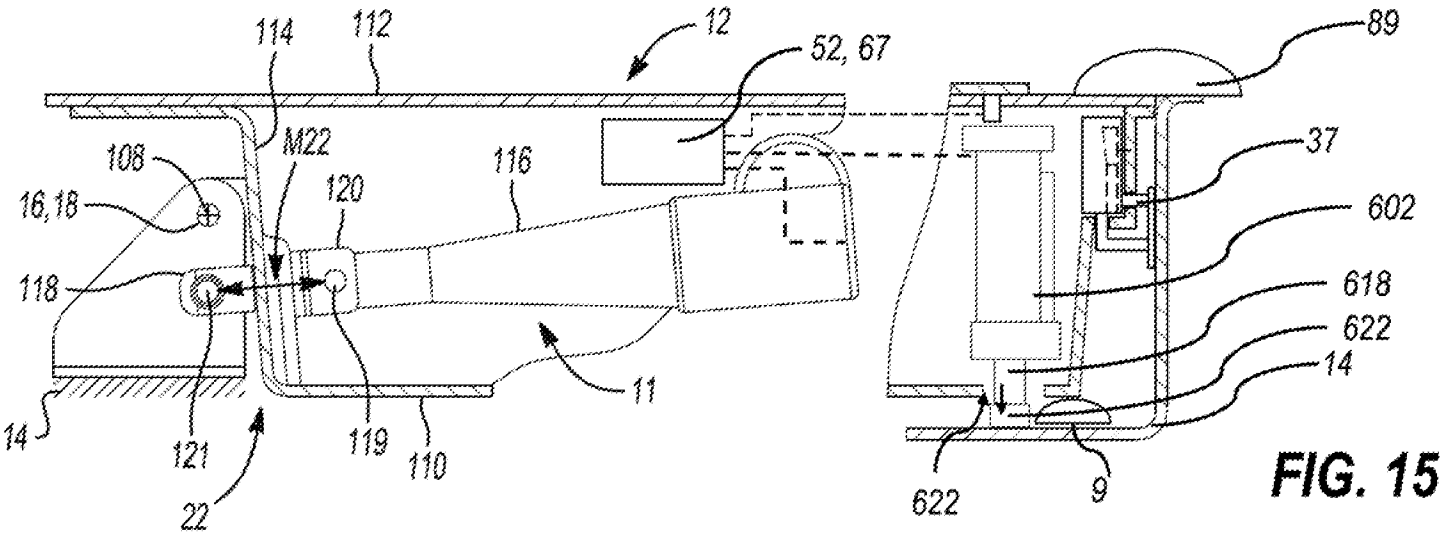
Figure 16:
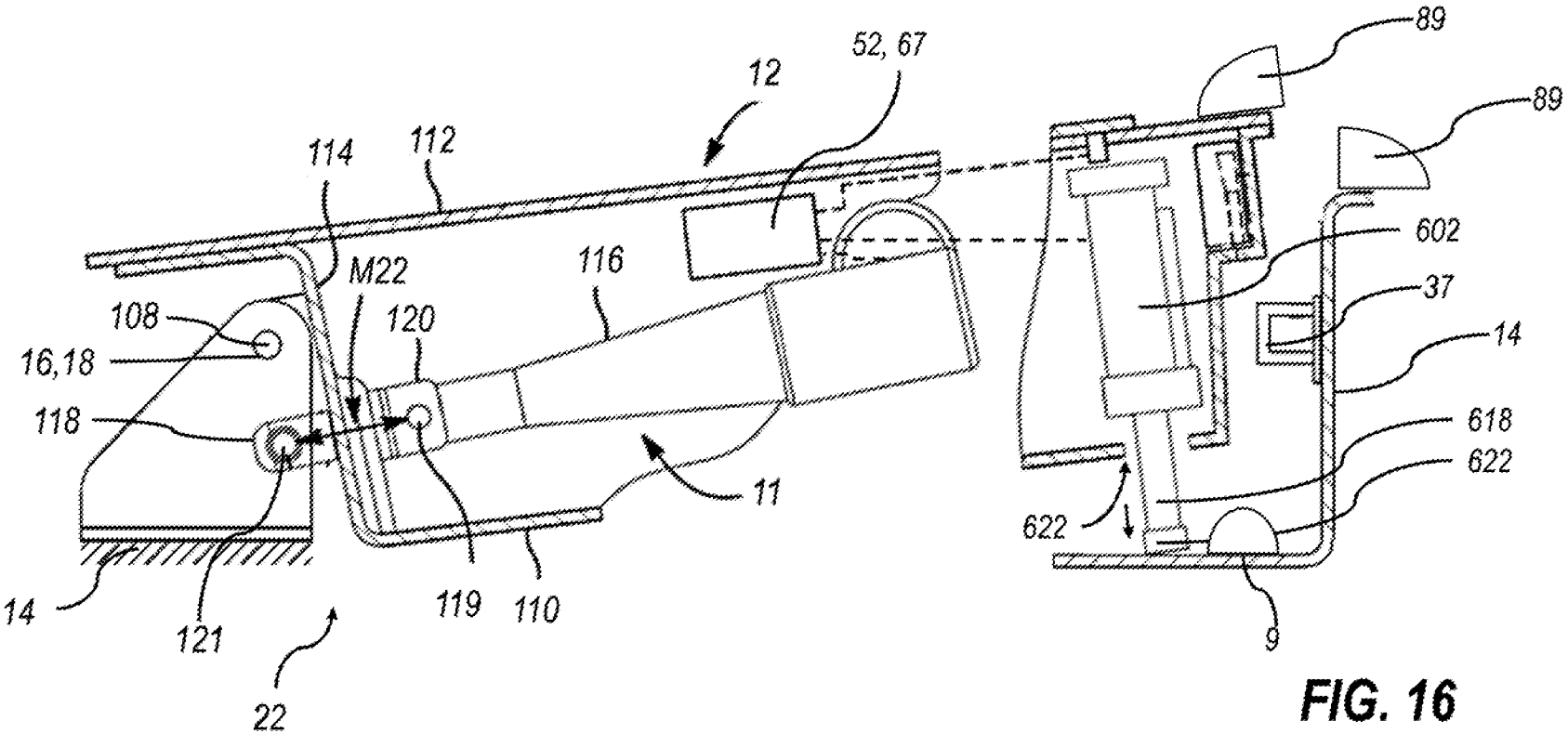
Figure 17:
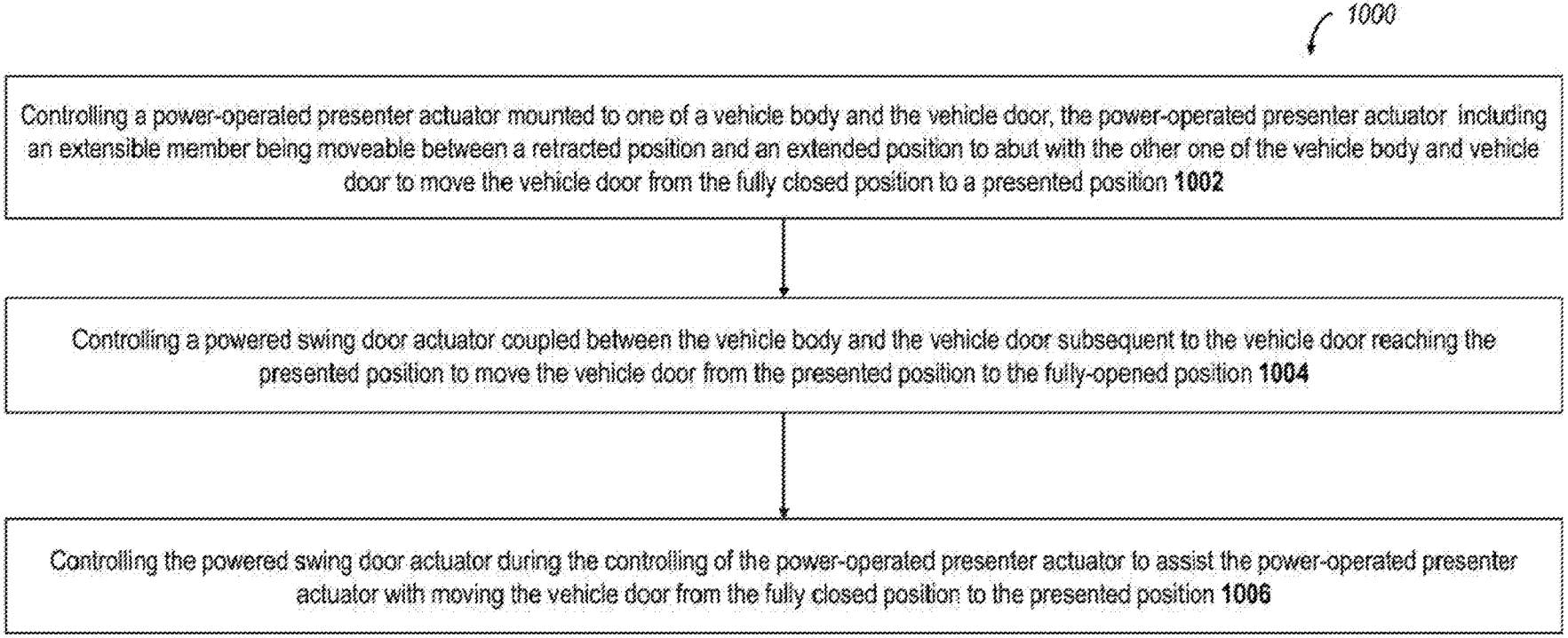
FIG. 17 is a flow chart illustrating a method of opening a vehicle door using the compact power door presenter assembly in conjunction with operation of a power swing door actuator of FIGS. 14 to 16, in accordance with an illustrative embodiment.

Now referring to FIGS. 14 to 16, there is illustrated an operation of the power-operated presenter actuator 70 moving the door 12 from a closed position (FIG. 14) to a presented position (FIG. 17). FIG. 14 illustrates the extensible member 618 in engagement with the vehicle body 14. Extensible member 618 is configured to a non-permanent, abutting contact with vehicle door 12. Powered swing door actuator 22 is illustrated to assist with moving the door 12 after the door 12 has been moved to the presented position, or may assist in a tandem operation with power-operated presenter actuator 70 to move the door 12 to the presented position, in a manner as described herein. It is recognize that door 12 may not be provided with powered swing door actuator 22, but solely being configured with power-operated presenter actuator 70 for subsequent manual movement.

Now referring to FIG. 17, there is illustrated an exemplary method 1000 of controlling movement of a vehicle door 12 from a fully closed position to a fully open position. The method 1000 including the steps of controlling a power-operated presenter actuator 70 mounted to one of a vehicle body 14 and the vehicle door 12, the power-operated presenter actuator 70 including an extensible member 618 being moveable between a retracted position and an extended position to abut (e.g. in non-permanent manner) with the other one of the vehicle body 14 and vehicle door 12 to move the vehicle door 12 from the fully closed position to a presented position 1002, and controlling a powered swing door actuator 22 coupled (e.g. in a permanent manner) between the vehicle body 14 and the vehicle door 12 subsequent to the vehicle door 12 reaching the presented position (e.g. see FIG. 16) to move the vehicle door 12 from the presented position to the fully-opened position (see FIG. 3C) 1004. The method 1000 may also include the step of controlling the powered swing door actuator 22 during the controlling of the power-operated presenter actuator 70 to assist the power-operated presenter actuator 70 with moving the vehicle door 12 from the fully closed position to the presented position 1006. The method 1000 may further include the step of controlling the power-operated presenter actuator 70 to move the extensible member 618 from the extended position to the retracted position in response to sensing the vehicle door 12 being moved to the presented position and a manual user having control of the vehicle door 12. The method 1000 may further include the step of controlling the primary latch assembly 13 mounted to the vehicle door 12 to release a primary striker 37 mounted to the vehicle body 14 when the vehicle door 12 is located in its closed position simultaneously to powered movement of the extensible member 618 causing movement of the vehicle door 12 from its closed position to its presented position. The method 1000 may further include the step of controlling the primary latch assembly 13 mounted to the vehicle door 12 to release a primary striker 37 mounted to the vehicle body 14 when the vehicle door 12 is located in its closed position subsequently to powered movement of the extensible member 618 causing movement of the vehicle door 12 from its closed position to its presented position. The method 1000 may further include the step of maintaining the extensible member 618 in its extended position during the vehicle door 12 being between the presented position and the fully-open position. The method 1000 may further include the step of retracting the extensible member 618 from its extended position to its retracted position in response to the vehicle door being sensed to be moving from its fully-opened position to the presented position.

The foregoing description of the embodiments has been provided for purposes of illustration and description. It is not intended to be exhaustive or to limit the disclosure. Individual elements, assemblies/subassemblies, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A power door presenter system for a motor vehicle having a vehicle door moveable relative to a vehicle body between a closed position, a presented position, and a fully-open position, the system comprising:

a power-operated presenter actuator mounted to one of the vehicle body and the vehicle door, the power-operated presenter actuator including a leadscrew fixed against linear translation and an extensible member being moveable between a retracted position and an extended position along a first axis, and having a motor with a motor shaft extending along a second axis and being operable for powered rotation of the leadscrew that results in powered movement of the extensible member, wherein powered movement of the extensible member between its retracted and extended position results in corresponding movement of the vehicle door between the closed position and the presented position, wherein the power door presenter system further includes a driven gear configured to rotate about the first axis and a drive gear configured to rotate about the second axis, said driven gear and said drive gear being configured in meshed engagement with one another, and wherein said first axis and said second axis are spaced laterally from one another by a distance equal to a sum of radii of said driven gear and said drive gear.

2. The power door presenter system of claim 1, further including a gear box positioned between the motor shaft and the drive gear for providing a gear reduction between the motor shaft and the drive gear.

3. The power door presenter system of claim 1, further comprising a primary latch assembly mounted to the vehicle door and operable to releasably hold a primary striker mounted to the vehicle body when the vehicle door is located in its closed position, wherein the primary latch assembly is operable to release the primary striker one of simultaneously to and subsequently to powered movement of the extensible member causing movement of the vehicle door from its closed position to its presented position.

4. The power door presenter system of claim 3, wherein the power-operated presenter actuator is integrated with the primary latch assembly.

5. The power door presenter system of claim 1, further comprising a control system for controlling actuation of the power-operated presenter actuator, wherein the control system includes a sensor operable to detect when the vehicle door is under manual control of a user so as to control actuation of the power-operated presenter actuator to move the extensible member from the extended position to the retracted position in response to detection of the vehicle door under manual control.

6. The power door presenter system of claim 1, further including a gear train positioned between the motor shaft and the extensible member, the gear train configured to transmit torque from the motor shaft to the extensible member and configured to be back driveable to transmit torque from the extensible member to the motor shaft, wherein the motor and the extensible member are provided on one side of the gear train.

7. The power door presenter system of claim 1, further including an elastic bumper connected to an end of the extensible member for abutment with one of the vehicle body and vehicle door.

8. The power door presenter system of claim 1, further including a sensor mounted about the motor shaft and configured to convert detected rotations into an absolute linear position electrical signal for determining a linear position of the extensible member.

9. The power door presenter system of claim 1, wherein the presenter actuator includes an actuator housing, wherein the motor is an electric motor supported by the actuator housing, and wherein the leadscrew does not extend outside of the housing when the moves from its retracted position toward its extended position.

10. The power door presenter system of claim 1, further including a gear train positioned between the motor shaft and the extensible member and a clutch positioned between the gear train and the extensible member.

11. A power door presenter system for a motor vehicle having a vehicle door moveable relative to a vehicle body between a closed position, a presented position, and a fully-open position, the system comprising:

a power-operated presenter actuator mounted to one of the vehicle body and the vehicle door, the power-operated presenter actuator including an extensible member being moveable between a retracted position and an extended position along a first axis, and having a motor with a motor shaft extending along a second axis and being operable for powered movement of the extensible member, wherein powered movement of the extensible member between its retracted and extended position results in corresponding movement of the vehicle door between the closed position and the presented position, and further including a driven gear configured to rotate about the first axis and a drive pear configured to rotate about the second axis, said driven gear and said drive gear being configured in meshed engagement with one another; and further including a nut tube fixedly coupled to said driven gear for conjoint rotation therewith, wherein said nut tube is fixed against axial translation and said extensible member is configured in threaded engagement with said nut tube for axial translation between its retracted and extended positions in response to rotation of said nut tube.

12. The power door presenter system of claim 11, further including a lead screw fixedly attached to said extensible member in coaxial alignment with said first axis, said lead screw being threadedly engaged with said nut tube.

13. A power door presenter system for a motor vehicle having a vehicle door moveable relative to a vehicle body between a closed position, a presented position, and a fully-open position, the system comprising:

a power-operated presenter actuator mounted to one of the vehicle body and the vehicle door, the power-operated presenter actuator including an extensible member being moveable between a retracted position and an extended position along a first axis, and having a motor with a motor shaft extending along a second axis and being operable for powered movement of the extensible member, wherein powered movement of the extensible member between its retracted and extended position results in corresponding movement of the vehicle door between the closed position and the presented position, and further comprising a powered swing door actuator coupled between the vehicle body and the vehicle door, the powered swing door actuator operable to move the vehicle door between its closed position and one of a partially open and the fully-open position, and further comprising a control system for controlling actuation of the powered swing door actuator in coordination with actuation of the power-operated presenter actuator, wherein the control system is operable to control actuation of the motor to cause movement of the vehicle door from the closed position to the presented position, and subsequently control actuation of the powered swing door actuator to cause movement of the vehicle door from the presented position to the fully-open position, and wherein the control system simultaneously controls actuation of the powered swing door actuator during actuation of the power-operated presenter actuator to cause movement of the vehicle door from the closed position to the presented position.

14. A power door presenter system for a motor vehicle having a vehicle door moveable relative to a vehicle body between a closed position, a presented position, and a fully-open position, the system comprising:

an extensible member for engaging the vehicle body and moveable between a retracted position and an extended position along a first axis;

a motor having a motor shaft extending along a second axis and being operable for powered movement of the extensible member, wherein powered movement of the extensible member between its retracted and extended position results in corresponding movement of the vehicle door between the closed position and the presented position, and a drive gear rotatable about the second axis and coupled with the motor shaft, and a driven gear rotatable about the first axis and meshed with the drive gear;

a nut tube rotatable with the driven gear about the first axis; and a lead screw in threaded engagement with the nut tube and coupled with the extensible member for converting rotational movement of the nut tube into linear movement of the lead screw and extensible member.

* * * * *